US010862249B2

(12) United States Patent
Ju et al.

(10) Patent No.: US 10,862,249 B2
(45) Date of Patent: Dec. 8, 2020

(54) ELECTRICAL CONNECTOR

(71) Applicant: LOTES CO., LTD, Keelung (TW)

(72) Inventors: Ted Ju, Keelung (TW); Wu Feng, Keelung (TW); Ya Jun Zeng, Keelung (TW); Nan Fang He, Keelung (TW); Jun Fan, Keelung (TW); Jin Ke Hu, Keelung (TW); Guo Sheng Zhou, Keelung (TW); Chin Chi Lin, Keelung (TW)

(73) Assignee: LOTES CO., LTD, Keelung (TW)

( * ) Notice: Subject to any disclaimer, the term of this patent is extended or adjusted under 35 U.S.C. 154(b) by 26 days.

(21) Appl. No.: 16/535,470

(22) Filed: Aug. 8, 2019

(65) Prior Publication Data

US 2019/0363495 A1 Nov. 28, 2019

Related U.S. Application Data

(63) Continuation-in-part of application No. 15/648,745, filed on Jul. 13, 2017, now Pat. No. 10,439,332, (Continued)

(30) Foreign Application Priority Data

Dec. 28, 2016 (CN) ..... 2016 2 1450734

(51) Int. Cl.
*H01R 13/6585* (2011.01)
*H01R 13/6594* (2011.01)
(Continued)

(52) U.S. Cl.
CPC ..... *H01R 13/6585* (2013.01); *H01R 12/724* (2013.01); *H01R 13/6581* (2013.01);
(Continued)

(58) Field of Classification Search
CPC ..... H01R 13/6585; H01R 13/6581
(Continued)

(56) References Cited

U.S. PATENT DOCUMENTS 5,362,249 A 11/1994 Carter
7,604,512 B1 10/2009 Chen
(Continued)

FOREIGN PATENT DOCUMENTS

CN 203445352 U 2/2014

*Primary Examiner* — Neil Abrams
(74) *Attorney, Agent, or Firm* — Locke Lord LLP; Tim Tingkang Xia, Esq.

(57) ABSTRACT

An electrical connector is provided for a mating connector to be inserted thereto. The electrical connector includes an insulating body having a tongue, and multiple terminals. A middle grounding sheet is located between the terminals in upper and lower rows, and has at least one first through hole. Each of left and right sides of the middle grounding sheet has a latch slot and a notch. The insulating body has a first insulating post entering the first through hole and a second insulating post entering the notch. A dimension of the second insulating post is larger than a dimension of the first insulating post. A metal shell frames outside the insulating body to form an insertion space. A first clearance between a first protruding portion and a shielding casing of the mating connector is more than or equal to 0.001 mm and less than or equal to 0.0449 mm.

20 Claims, 21 Drawing Sheets

Related U.S. Application Data which is a continuation of application No. 15/263,413, filed on Sep. 13, 2016, now abandoned, which is a continuation of application No. 14/626,709, filed on Feb. 19, 2015, now Pat. No. 9,917,405, application No. 16/535,470, filed on Aug. 8, 2019, which is a continuation-in-part of application No. 15/648,727, filed on Jul. 13, 2017, now Pat. No. 10,490,940.

(60) Provisional application No. 62/024,728, filed on Jul. 15, 2014, provisional application No. 61/942,830, filed on Feb. 21, 2014, provisional application No. 62/425,162, filed on Nov. 22, 2016.

(51) Int. Cl.

| | |
|---|---|
| ***H01R 13/6583*** | (2011.01) |
| ***H01R 24/60*** | (2011.01) |
| ***H01R 13/6581*** | (2011.01) |
| ***H01R 13/6591*** | (2011.01) |
| ***H01R 12/72*** | (2011.01) |
| *H01R 107/00* | (2006.01) |

(52) U.S. Cl.
CPC ..... *H01R 13/6583* (2013.01); *H01R 13/6591* (2013.01); *H01R 13/6594* (2013.01); *H01R 24/60* (2013.01); *H01R 2107/00* (2013.01)

(58) Field of Classification Search
USPC ..... 439/607.05, 607.09
See application file for complete search history.

(56) References Cited

U.S. PATENT DOCUMENTS

| | | | | |
|---|---|---|---|---|
| 7,722,381 | B2 * | 5/2010 | Hiramatsu | H01R 13/4362 439/385 |
| 7,841,904 | B2 | 11/2010 | Lin et al. | |
| 9,300,090 | B2 * | 3/2016 | Xu | H01R 13/187 |
| 9,312,641 | B2 * | 4/2016 | Wang | H01R 13/6585 |
| 9,385,484 | B2 * | 7/2016 | Chen | H01R 13/6582 |
| 9,461,415 | B2 * | 10/2016 | Guo | H01R 13/41 |
| 9,673,569 | B2 | 6/2017 | Zhang | |
| 9,728,899 | B2 * | 8/2017 | Peng | H01R 13/6597 |
| 9,780,496 | B2 | 10/2017 | Guo et al. | |
| 9,865,962 | B2 | 1/2018 | Zhao | |
| 9,887,485 | B2 | 2/2018 | Lambie et al. | |
| 9,917,405 | B2 * | 3/2018 | Ju | H01R 13/6583 |
| 9,979,134 | B2 | 5/2018 | Yu et al. | |
| 10,050,365 | B1 * | 8/2018 | Ju | H01R 13/648 |
| 10,096,941 | B2 | 10/2018 | Ju | |
| 10,218,134 | B2 * | 2/2019 | Tsai | H01R 13/6585 |
| 10,276,982 | B2 * | 4/2019 | Feng | H01R 13/6596 |
| 10,439,332 | B2 * | 10/2019 | Ju | H01R 13/6585 |
| 10,490,940 | B2 * | 11/2019 | Ju | H01R 13/6582 |
| 2008/0108235 | A1 | 5/2008 | Muroi et al. | |
| 2014/0024263 | A1 | 1/2014 | Dong et al. | |
| 2014/0099824 | A1 | 4/2014 | Chou | |
| 2015/0270646 | A1 | 9/2015 | Kao et al. | |
| 2015/0295362 | A1 | 10/2015 | Tziviskos et al. | |
| 2016/0149348 | A1 | 5/2016 | Kao et al. | |
| 2016/0294121 | A1 | 10/2016 | Daughtry, Jr. et al. | |
| 2017/0279234 | A1 | 9/2017 | Tsai | |
| 2017/0294746 | A1 | 10/2017 | Fang et al. | |
| 2017/0302013 | A1 | 10/2017 | Ju et al. | |
| 2017/0310501 | A1 | 10/2017 | Wang et al. | |
| 2018/0183184 | A1 | 6/2018 | Tsai | |
| 2019/0363495 | A1 * | 11/2019 | Ju | H01R 13/6585 |

* cited by examiner

100

100

100

ELECTRICAL CONNECTOR

CROSS-REFERENCE TO RELATED PATENT APPLICATION

This application is a continuation-in-part of U.S. application Ser. No. 15/648,745, filed Jul. 13, 2017, which is a continuation application of U.S. application Ser. No. 15/263,413, filed Sep. 13, 2016, which is a continuation application of U.S. application Ser. No. 14/626,709, filed Feb. 19, 2015, which itself claims priority to and the benefit of, pursuant to 35 U.S.C. § 119(e), U.S. provisional patent application Ser. No. 61/942,830, filed Feb. 21, 2014, and U.S. provisional patent application Ser. No. 62/024,728, filed Jul. 15, 2014. The disclosures of the above applications are incorporated herein in their entireties by reference.

This application is a continuation-in-part of U.S. application Ser. No. 15/648,727, filed Jul. 13, 2017, which itself claims priority to and the benefit of, pursuant to 35 U.S.C. § 119(e), U.S. provisional patent application Ser. No. 62/425,162, filed Nov. 22, 2016, and claims priority to and benefit of, under 35 U.S.C. § 119(a), Patent Application No. 201621450734.0 filed in P.R. China on Dec. 28, 2016. The disclosures of the above applications are also incorporated herein in their entireties by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector, and more particularly to an electrical connector having a good shielding effect.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Chinese Patent CN201320378153.0 discloses, in paragraph [0008] of the specification, an electrical connector, which includes an insulating body 1, a first terminal group 2 retained to the insulating body 1, and a shielding member 4. The insulating body 1 includes a base and a tongue 12 extending forward. The tongue 12 has a first surface 121 and a second surface 122 disposed opposite to each other. The first terminal group 2 is exposed to the first surface 121, and the shielding member 4 is disposed at the tongue 12 and located between the first surface 121 and the second surface 122. The first terminal group 2 includes a grounding terminal 21. The grounding terminal 21 is provided with a contact portion 211 protruding towards the shielding member 4 and contacting the shielding member 4. Paragraph [0020] discloses that the shielding member 4 is integrally formed at a mating plate 13, the first terminal group 2 and a second terminal group 3 are oppositely assembled to the mating plate 13 and then assembled forward to an assembly frame 14 together with the mating plate 13, forming the insulating body 1. However, when the electrical connector of such a structure is used for transmitting high-speed signals, electromagnetic radiation produced by the first terminal group and the second terminal group is easy to leak backward, resulting in that crosstalk is produced during signal transmission at tails of the first terminal group and the second terminal group, which affects signal transmission quality of the electrical connector. In addition, terminals of such an electrical connector are simultaneously assembled to the first surface and the second surface, and as there are more terminals and the tongue is smaller, operations are inconvenient, which easily results in that the terminals are not mounted firmly and tilt upward, damaging the whole electrical connector.

Therefore, a heretofore unaddressed need to design a new electrical connector exists in the art to address the aforementioned deficiencies and inadequacies.

SUMMARY

The present invention is directed to an electrical connector of which upper and lower grounding sheets can cover a base portion of an insulating body to increase coverage of an inner metal shell and achieve a good shielding effect.

In certain embodiments, an electrical connector includes an insulation body, multiple terminals, an inner metal shell, and an outer metal shell. The insulation body has a base and a tongue located in a front end of the base. The multiple terminals are fixedly arranged in the base in upper and lower rows. Each of the upper row of terminals has a contact portion exposed to an upper surface, and each of the lower row of terminals has a contact portion exposed to a lower surface of the tongue. The inner metal shell has at least one covering portion disposed on the upper surface of the tongue, and at least one extending portion extending from the covering portion to the base, and the extending portion covers the base. The outer metal shell wraps the inner metal shell externally.

In one embodiment, the extending portion has at least one contacting arm, and the contacting arm urges against an inner wall of the outer metal shell.

In one embodiment, the end of the contacting arm bends downward to form a positioning portion, the base is provided with a concave slot corresponding to the positioning portion, and the positioning portion is received in the concave slot.

In one embodiment, a first receiving space is depressed from the base, and the extending portion is accommodated in the first receiving space.

In one embodiment, the inner metal shell further has a connection portion for vertically connecting the covering portion and the extending portion.

In one embodiment, the inner metal shell includes an upper grounding plate and a lower grounding plate, the upper grounding plate covers the upper surface of the tongue, and the lower grounding plate adjoins the lower surface of the tongue.

In one embodiment, each of two sides of the tongue is provided with a reserving slot, each of two side walls of the upper grounding plate is provided with a mating portion, each of two side walls of the lower grounding plate is provided with a fixing portion corresponding to the mating portion, and the mating portions and the fixing portions are accommodated in the reserving slot in a mutually mating manner to enable the inner metal shell to wrap a rear end of the tongue.

In one embodiment, the lower grounding plate has a stopping portion, and the stopping portion adjoins a lower surface of the base.

In one embodiment, the upper row of terminals and the lower row of terminals respectively include at least two grounding terminals. The grounding terminals are located at edges of the tongue and are each provided with a protruding portion in a front end thereof. The protruding portions partially protrude beyond the edges of the tongue.

In one embodiment, the upper row terminal and the lower row terminal are symmetrically arranged on the tongue, each terminal in the upper row terminal has a first rear portion disposed in the base, each terminal in the lower row terminal has a second rear portion disposed in the base, and the first rear portion and the second rear portion are arranged in two rows.

In one embodiment, the electrical connector further includes a middle grounding plate. The middle grounding plate includes a flat plate portion retained in the tongue and located between the upper row terminal and the lower row terminal, and a vertical portion extending downward from a rear end of the flat plate portion, and the vertical portion is located between the first rear portion and the second rear portion.

In one embodiment, a snap-fit slot depressed inward is formed on each of the two sides of the tongue, and the flat plate portion is partially exposed to the snap-fit slot.

In one embodiment, the tongue is assembled on the base, a lower surface of the base has a second receiving space, the insulation body further includes a plastic block, and the plastic block is accommodated in the second receiving space and assembled on the base.

Another aspect relates to an electrical connector, including an insulation body having a base and a tongue located in a front end of the base, at least one first terminal and at least one second terminal arranged in the base in an upper row and a lower row and exposed to an upper surface and a lower surface of the tongue, and a middle grounding plate having a body portion fixed to the tongue and located between the first terminal and the second terminal. The first terminal has a first front edge, the second terminal has a second front edge, and the first front edge, the second front edge and an edge in a front end of the body portion are located in a same vertical plane.

In one embodiment, the electrical connector further includes multiple first terminals and multiple second terminals, the first terminals include two grounding terminals, the second terminals include two grounding terminals, the tongue has two side surfaces, each of the two side surfaces is connected to the upper surface and the lower surface, the two grounding terminals of the first terminals are located on the upper surface at a location closest to the side surfaces, and the two grounding terminals of the second terminals are located on the lower surface at a location closest to the side surfaces.

In one embodiment, the electrical connector further includes two third terminals located in a same row with the first terminal and two fourth terminals located in a same row with the second terminal, the third terminals have a third front edge located behind the first front edge, and the fourth terminals have a fourth front edge located behind the first front edge.

In one embodiment, the first terminals are adjacent to two sides of each of the third terminals, and the second terminals are adjacent to two sides of each of the fourth terminals.

In one embodiment, multiple first terminals and multiple second terminals are symmetrically disposed in a vertical direction, and the third terminals and the fourth terminals are symmetrically disposed in the vertical direction.

In one embodiment, the first terminal has an upper board and a first inclined plane, the first inclined plane is disposed at a location on the upper board close to the upper surface, the first inclined plane is connected to the first front edge, and a junction between the first inclined plane and the first front edge is lower than the upper surface; and the second terminal has a lower board and a second inclined plane, the second inclined plane is disposed at a location on the lower board close to the lower surface, the second inclined plane is connected to the second front edge, and a junction between the second inclined plane and the second front edge is higher than the lower surface.

In one embodiment, each of two sides of the body portion is provided with a side edge, a notch is concavely provided on each of the two side edges, and at least one first through hole is disposed between the two notches.

In one embodiment, the body portion is provided with two second through holes which are in front of the first through hole.

In one embodiment, a first protruding portion is convexly disposed on each of the two side edges of the body portion, the first protruding portions are in front of the notches, two third through holes are disposed between the two first protruding portions, and the second through holes are disposed between the third through holes and the first through hole.

In one embodiment, a length of the first through hole along a front-rear direction is respectively larger than a length of each of the second through holes along a front-rear direction and a length of each of the third through holes along a front-rear direction.

In one embodiment, the insulation body is provided with multiple insulation blocks located in the notches, the first through holes, the second through holes and the third through holes respectively.

In one embodiment, the tongue has two side surfaces, each of the two side surfaces is connected to the upper surface and the lower surface, and a snap-fit slot depressed inward is formed on each of the side surfaces, and the side edges are exposed to the snap-fit slots.

In one embodiment, a second protruding portion is convexly disposed on each of the two side edges of the body portion, the second protruding portions are behind the notches, and the second protruding portions are located in the base.

In one embodiment, two fourth through holes are disposed between the two second protruding portions, the fourth through holes are behind the first through hole, and the insulation body is provided with insulation blocks located in the fourth through holes.

In one embodiment, the notch and the second protruding portion on one side of the body portion are continuously disposed in a front-rear direction.

In one embodiment, a step portion is disposed on the tongue at a location close to the base, a thickness of the step portion is greater than a thickness of the tongue and less than a thickness of the base, the side edges are correspondingly exposed to the tongue, and the notches are correspondingly located in the step portion.

In one embodiment, the width between the two notches is the minimum width of the body portion.

In one embodiment, the tongue has a front surface connected to the upper surface and the lower surface respectively, and the first front edge is behind the front surface.

In one embodiment, an outer metal shell is sleeved outside the base and the tongue, and forms an insertion space with the tongue, the outer metal shell has a fifth front edge, the first terminal and the second terminal are both exposed to the insertion space, and the fifth front edge is forward beyond the front surface.

In one embodiment, a first horizontal distance exists between the first front edge and the front surface, a second horizontal distance exists between the front surface and the fifth front edge, and the first horizontal distance is equal to the second horizontal distance.

Another aspect relates to: an electrical connector is configured for a mating connected to be inserted thereto, the mating connector having a plastic body and a shielding casing wrapping the plastic body, the shielding casing having a first wall surface and a second wall surface connected with the first wall surface. The electrical connector includes: an insulating body, having a base and a tongue provided at a front end of the base; a plurality of terminals, formed in an upper row and a lower row, and respectively arranged on an upper surface and a lower surface of the tongue; a middle grounding sheet, provided in the base and extending to the tongue, wherein the middle grounding sheet is located between the terminals in the upper row and the terminals in the lower row, the middle grounding sheet is provided with at least one first through hole, the middle grounding sheet has two latch slots and two notches concavely provided inward at a left side and a right side of the middle grounding sheet, each of the notches is located behind and adjacent to and connected to a corresponding one of the latch slots, the first through hole is located between the two notches, the insulating body has a first insulating post entering the first through hole and two second insulating posts correspondingly entering the notches, and a dimension of the second insulating post in a front-rear direction is larger than a dimension of the first insulating post in the front-rear direction; and a metal shell, wrapping the insulating body, wherein the metal shell frames outside the insulating body to form an insertion space for insertion of the mating connector, the metal shell is provided with at least one first protruding portion protruding toward the insertion space, the first protruding portion has a first height along a protruding direction thereof, the first height is greater than or equal to 0.042 mm and less than or equal to 0.08 mm, the first protruding portion has a first position limiting surface facing the first wall surface, a first clearance is provided between the first position limiting surface and the first wall surface, and the first clearance is greater than or equal to 0.001 mm and less than or equal to 0.0449 mm.

In certain embodiments, each of the notches is located closer to a central line of the middle grounding sheet in the front-rear direction relatively than each of the latch slots.

In certain embodiments, each of the notches has a first inner edge adjacent to and connected to the corresponding one of the latch slots, and the first insulating post is formed integrally with the first inner edge and abuts forward the first inner edge.

In certain embodiments, the mating connector has a retaining elastic sheet having a retaining portion fastened with a corresponding one of the latch slots, and when the retaining elastic sheet is fastened with the corresponding one of the latch slots, the retaining portion is located behind a front edge of the first protruding portion.

In certain embodiments, the metal shell is provided with at least one second protruding portion protruding toward the second wall surface, the mating connector has a retaining elastic sheet, the corresponding one of the latch slots has a side edge abutting the retaining elastic sheet, and when the retaining elastic sheet is fastened with the corresponding one of the latch slots, the retaining elastic sheet is at least partially located between the second protruding portion and the side edge of the corresponding one of the latch slots in a left-right direction.

In certain embodiments, the metal shell is provided with two second protruding portions protruding toward the second wall surface, one of the two second protruding portions is provided to be opposite to the side edge in the left-right direction, and the other of the two second protruding portions is located closer to an opening of the insertion space relative than the side edge.

In certain embodiments, the metal shell has two first protruding portions provided opposite to each other in a vertical direction, the tongue is located between the two first protruding portions, the metal shell further has at least one second protruding portion provided on at least one side of the tongue in the left-right direction, a first vertical surface passes through ends of the two first protruding portions facing the insertion space and an end of the second protruding portion facing the insertion space, and the tongue is located behind the first vertical surface.

In certain embodiments, the middle grounding sheet passes forward beyond a front end surface of the tongue and located behind the first vertical surface.

In certain embodiments, the first height remains unchanged before and after the mating connector is inserted into the insertion space.

In certain embodiments, each of the terminals has a mating portion exposed to a surface of the tongue, the terminals comprise at least one signal terminal, and the mating portion of the signal terminal and the first protruding portion are provided at least partially opposite to each other in a vertical direction.

In certain embodiments, the mating connector has a plurality of contact terminals, the mating portion of each of the terminals has a horizontal plate surface forming an abutting position with one of the contact terminals, and the first protruding portion extends forward beyond the horizontal plate surface of the signal terminal and extends backward beyond the abutting position formed by the signal terminal and the contact terminal.

In another aspect, an electrical connector is configured for a mating connected to be inserted thereto, the mating connector having a plastic body and a shielding casing wrapping the plastic body. The electrical connector includes: an insulating body, having a base and a tongue provided at a front end of the base; a plurality of terminals, formed in an upper row and a lower row, and respectively arranged on an upper surface and a lower surface of the tongue; a middle grounding sheet, provided in the base and extending to the tongue, wherein the middle grounding sheet is located between the terminals in the upper row and the terminals in the lower row, the middle grounding sheet is provided with at least one first through hole, the middle grounding sheet has two latch slots and two notches concavely provided inward at a left side and a right side of the middle grounding sheet, the first through hole is located between the two notches, each of the notches has a first inner edge relatively close to a front side of the tongue and connected to a corresponding one of the latch slots, a second inner edge formed to be relatively away from the front side of the tongue, and a third inner edge connecting the first inner edge and the second inner edge, the insulating body has a first insulating post entering the first through hole and two second insulating posts correspondingly entering the notches, and a dimension of the second insulating post in a front-rear direction is larger than a dimension of the first insulating post in the front-rear direction; and a metal shell, framing outside the insulating body to form an insertion space for insertion of the mating connector, wherein the metal shell is provided with at least one first protruding portion protruding toward the insertion space, a first clearance is provided between the first position limiting surface and the shielding casing, and the first clearance is greater than or equal to 0.001 mm and less than or equal to 0.0449 mm.

In certain embodiments, each of the notches is located closer to a central line of the middle grounding sheet in the front-rear direction relatively than each of the latch slots, and the second insulating post abuts forward the first inner edge, abuts backward the second inner edge and abuts the third inner edge in a left-right direction.

In certain embodiments, the mating connector has a retaining elastic sheet having a retaining portion fastened with one of the latch slots, and when the retaining elastic sheet is fastened with the one of the latch slots, the retaining portion is located behind a front edge of the first protruding portion.

In certain embodiments, each of the terminals has a mating portion exposed to a surface of the tongue, the terminals comprise at least one signal terminal, and the mating portion of the signal terminal and the first protruding portion are provided at least partially opposite to each other in a vertical direction.

In certain embodiments, the mating connector has a plurality of contact terminals, the mating portion of each of the terminals has a horizontal plate surface forming an abutting position with one of the contact terminals, and the first protruding portion extends forward beyond the horizontal plate surface of the signal terminal and extends backward beyond the abutting position formed by the signal terminal and the contact terminal.

In certain embodiments, the metal shell is provided with at least one second protruding portion protruding toward the insertion space, the mating connector has a retaining elastic sheet, one of the latch slots has a side edge abutting the retaining elastic sheet, and when the retaining elastic sheet is fastened with the one of the latch slots, the retaining elastic sheet is at least partially located between the second protruding portion and the side edge of the one of the latch slots in a left-right direction.

In certain embodiments, the metal shell has two first protruding portions provided opposite to each other in a vertical direction, the tongue is located between the two first protruding portions, the metal shell further has at least one second protruding portion provided on at least one side of the tongue in the left-right direction, a first vertical surface passes through ends of the two first protruding portions facing the insertion space and an end of the second protruding portion facing the insertion space, and the tongue is located behind the first vertical surface.

In certain embodiments, the middle grounding sheet passes forward beyond a front end surface of the tongue and located behind the first vertical surface.

In certain embodiments, the first protruding portion has a first height in a protruding direction thereof, and the first height remains unchanged before and after the mating connector is inserted into the insertion space.

Certain embodiments of the present invention has the following beneficial effects: in the electrical connector, the first insulating post is located between two second insulating posts, and the dimension of the second insulating post in the front-rear direction is larger than the dimension of the first insulating post, thus increasing an abutting area of the second insulating post and the middle grounding sheet, thereby firmly retaining the middle grounding sheet in the insulating body and further firmly retaining the middle grounding sheet in the electrical connector, avoiding from a displacement of the middle grounding sheet in an insertion and extraction process of the electrical connector and the mating connector, and controlling the first clearance formed between the first limiting surface and the first wall surface within a range of 0.001 millimeter to 0.059 millimeter, such that the fit clearance in the vertical direction during insertion of the mating connector and the electrical connector is reduced, a vertical shake amplitude of the mating connector in the insertion space is reduced, the mating connector may firmly mate with the electrical connector, and a vertical shake amplitude of the retaining portion in the insertion space is also reduced. In the electrical connector according to certain embodiments of the present invention, the displacement of the middle grounding sheet is avoided, and the vertical shake amplitude of the retaining portion in the insertion space is reduced, thus ensuring the electrical abutting between the retaining elastic sheet and the middle grounding sheet.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment.

DETAILED DESCRIPTION

Figure 1:
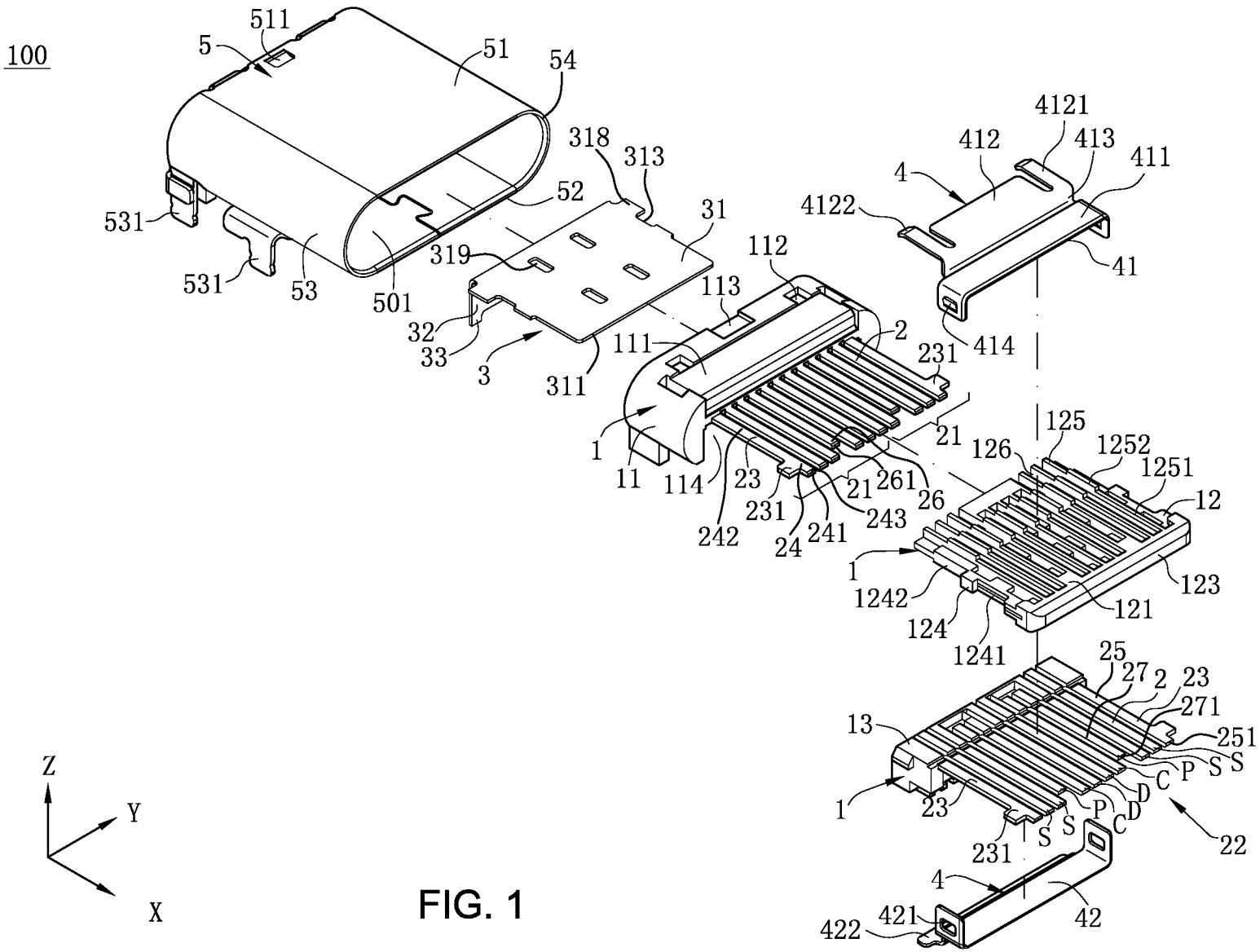
FIG. 1 is a three-dimensional exploded view of an electrical connector according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-20. In accordance with the purposes of this invention, as embodied and broadly described herein, this invention, in one aspect, relates to an electrical connector.

In the accompanying drawings of the specification, X axis is a front-rear direction (where the arrowhead of the X axis points to the front direction), Y axis is a left-right direction (where the arrowhead of the Y axis points to the right direction), and Z axis is a vertical direction (where the arrowhead of the Z axis points to the top direction).

Figure 3:
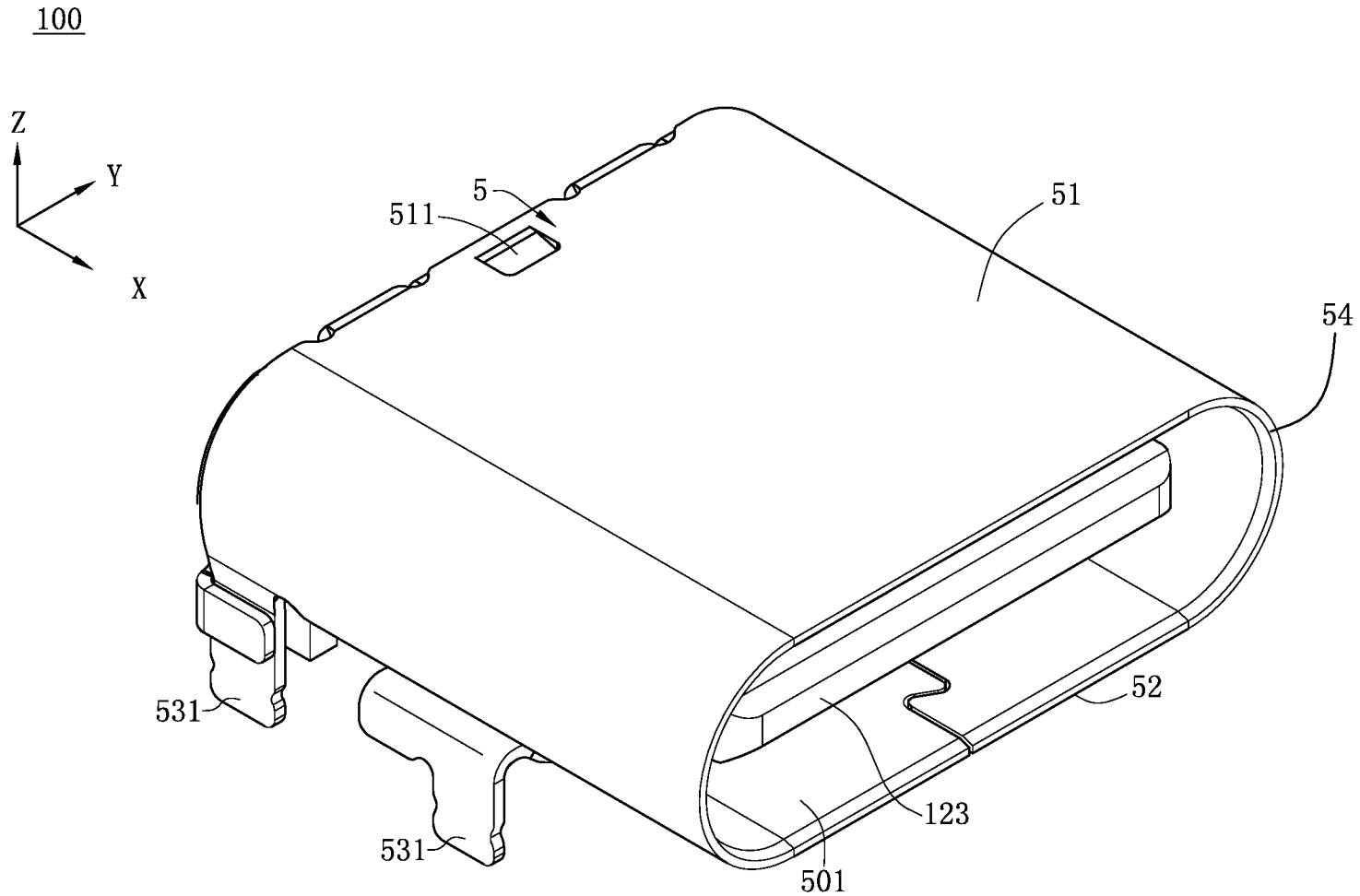
FIG. 3 is a three-dimensional assembly view of an electrical connector according to one embodiment of the present invention.
Figure 6:
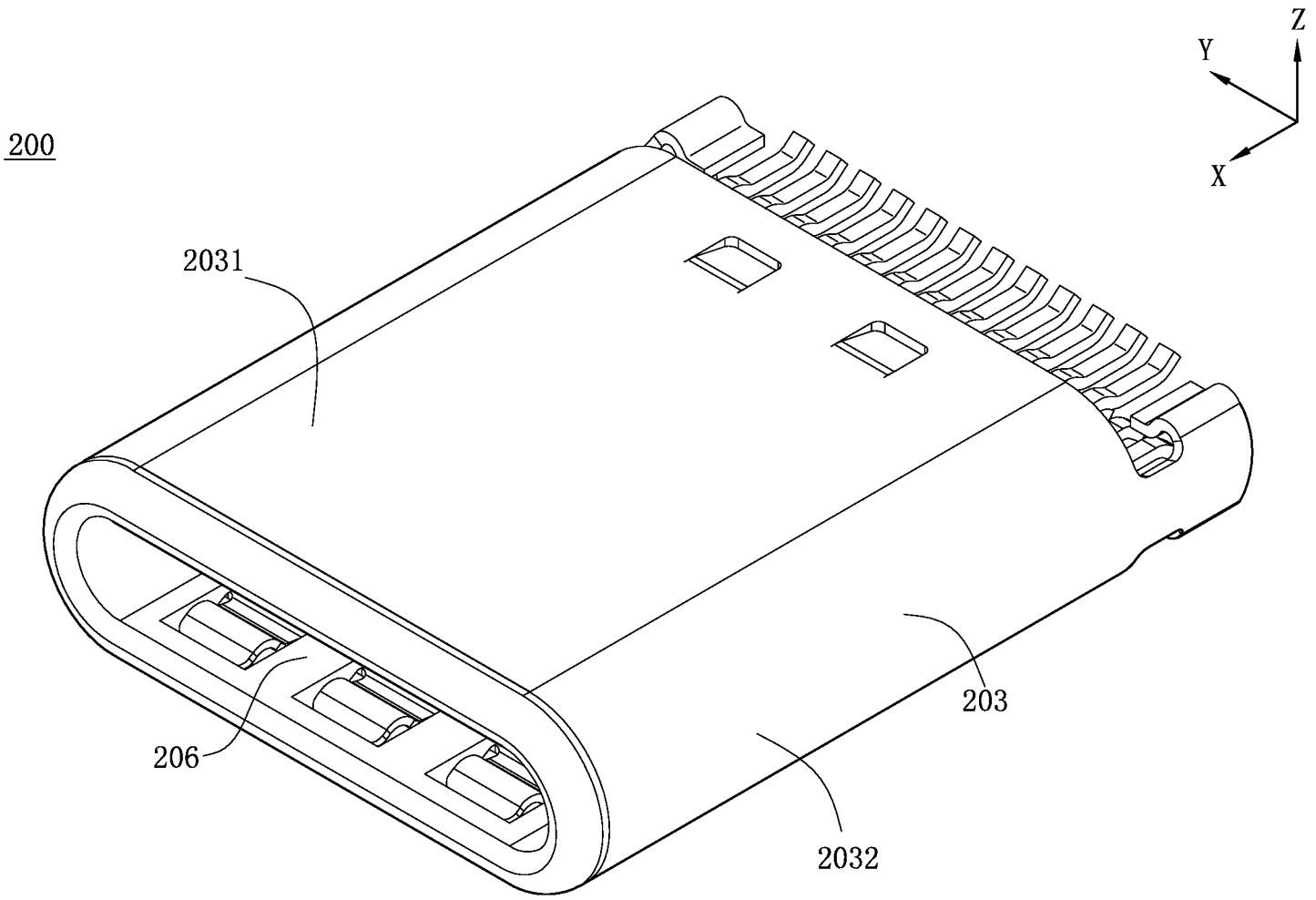
FIG. 6 is a three-dimensional assembly view of a mating connector according to one embodiment of the present invention.

As shown in FIG. 3 and FIG. 6, an electrical connector 100 according to a first embodiment of the present invention is an electrical connector socket that supports high-speed data transmission, and a mating connector 200 is an electrical connector plug that supports high-speed data transmission.

Figure 2:
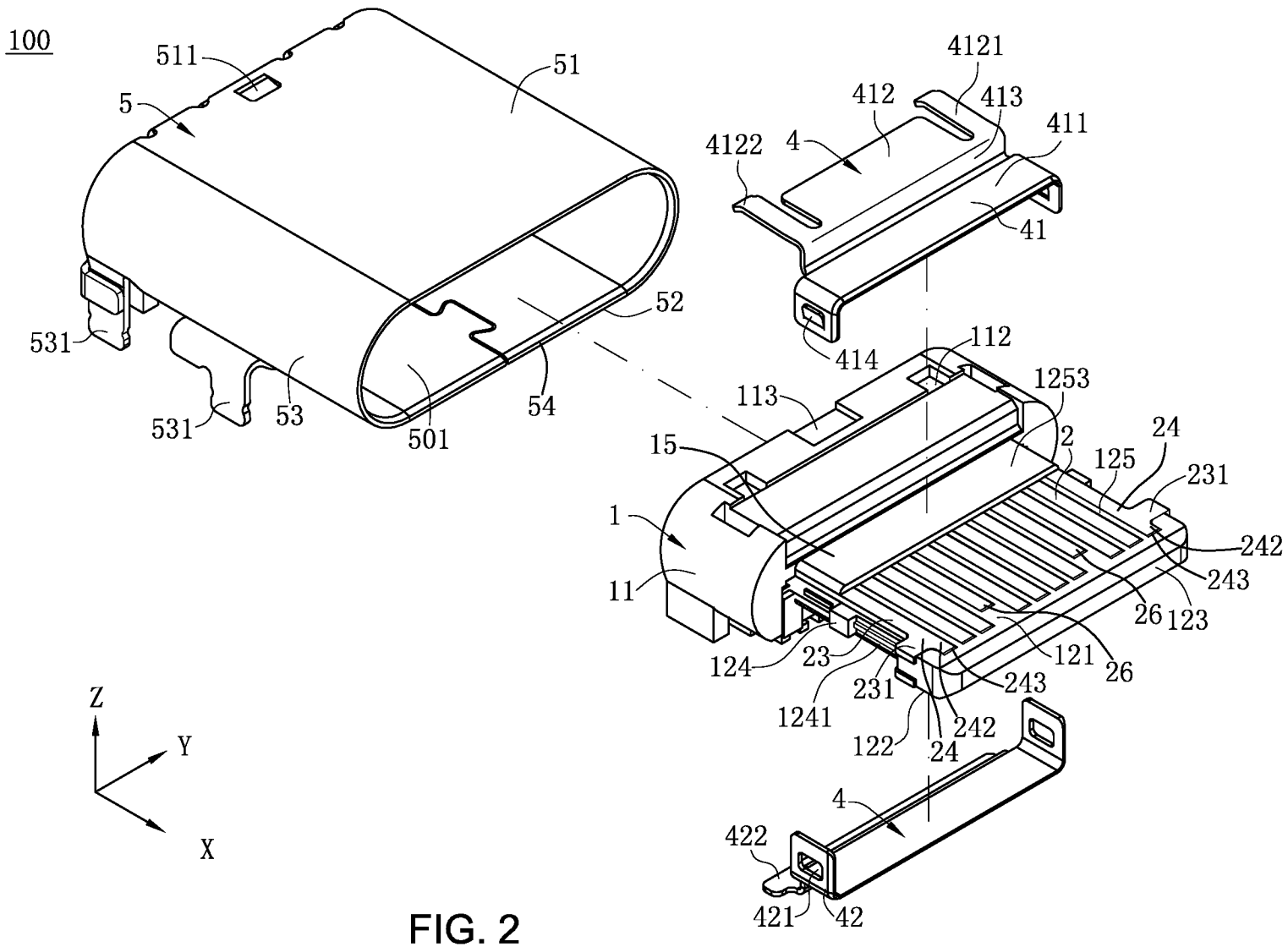
FIG. 2 is a partial three-dimensional exploded view of an electrical connector according to one embodiment of the present invention.

As shown in FIG. 1 to FIG. 3, the electrical connector 100 includes an insulating body 1, multiple terminals 2 fixedly disposed at the insulating body 1, a middle grounding sheet 3 fixedly disposed at the insulating body 1, an inner metal shell 4 covering and fixed onto the insulating body 1 and an outer metal shell 5 framed outside the insulating body 1 and the inner metal shell 4, to form an insertion space 501. The outer metal shell 5 has multiple soldering pins 531, and the soldering pins 531 can be correspondingly soldered onto a grounding circuit of a circuit board (not shown).

As shown in FIG. 5 to FIG. 7A, the mating connector 200 includes a plastic body 201, multiple contact terminals 202 fixed to the plastic body 201, a shielding casing 203 wrapping the plastic body 201, where the shielding casing 203 has two first wall surfaces 2031 located at upper and lower sides of the plastic body 201 and two second wall surfaces 2032 located on left and right sides of the plastic body 201, and each second wall surface 2032 connects the two first wall surfaces 2031 at the upper and lower sides thereof, a middle shielding sheet 205 fixedly disposed in the plastic body 201, two retaining elastic sheets 204 respectively fixedly disposed to two sides of the plastic body 201, and a mating cavity 206 disposed at a front end of the plastic body 201. When the mating connector 200 is inserted into the insertion space 501 of the electrical connector 100, in addition to that the contact terminals 202 are connected with the corresponding multiple terminals 2, each retaining elastic sheet 204 has a retaining portion 2040 capable of contacting the middle grounding sheet 3 to form a first grounding shielding structure, thus preventing electromagnetic radiation from passing through the insulating body 1 to leak backward to interfere signal transmission of the terminals 2. Moreover, the outer metal shell 5 and the shielding casing 203 form a second grounding shielding structure, which can thus effectively form a wholly surrounded shielding structure.

As shown in FIG. 1 and FIG. 2, in the electrical connector according to a first embodiment of the present invention, the insulating body 1 includes a base 11 and a tongue 12 located in a front end of the base 11, the tongue 12 is assembled to the front end of the base 11, and a plastic block 13 superimposed below the base 11. The middle grounding sheet 3 and the tongue 12 are formed in an embedding manner. In other embodiments (referring to a third embodiment), the base 11, the tongue 12 and the plastic block 13 may be integrally formed or formed in any other manners, and the middle grounding sheet 3 may also be formed with the insulating body 1 or the base 11 and the plastic block 13 in the embedding manner, which is not limited herein. A step portion 15 is disposed on the tongue 12 at a location close to the base 11. A thickness of the step portion 15 is greater than a thickness of the tongue 12 and less than a thickness of the base 11.

Figure 4:
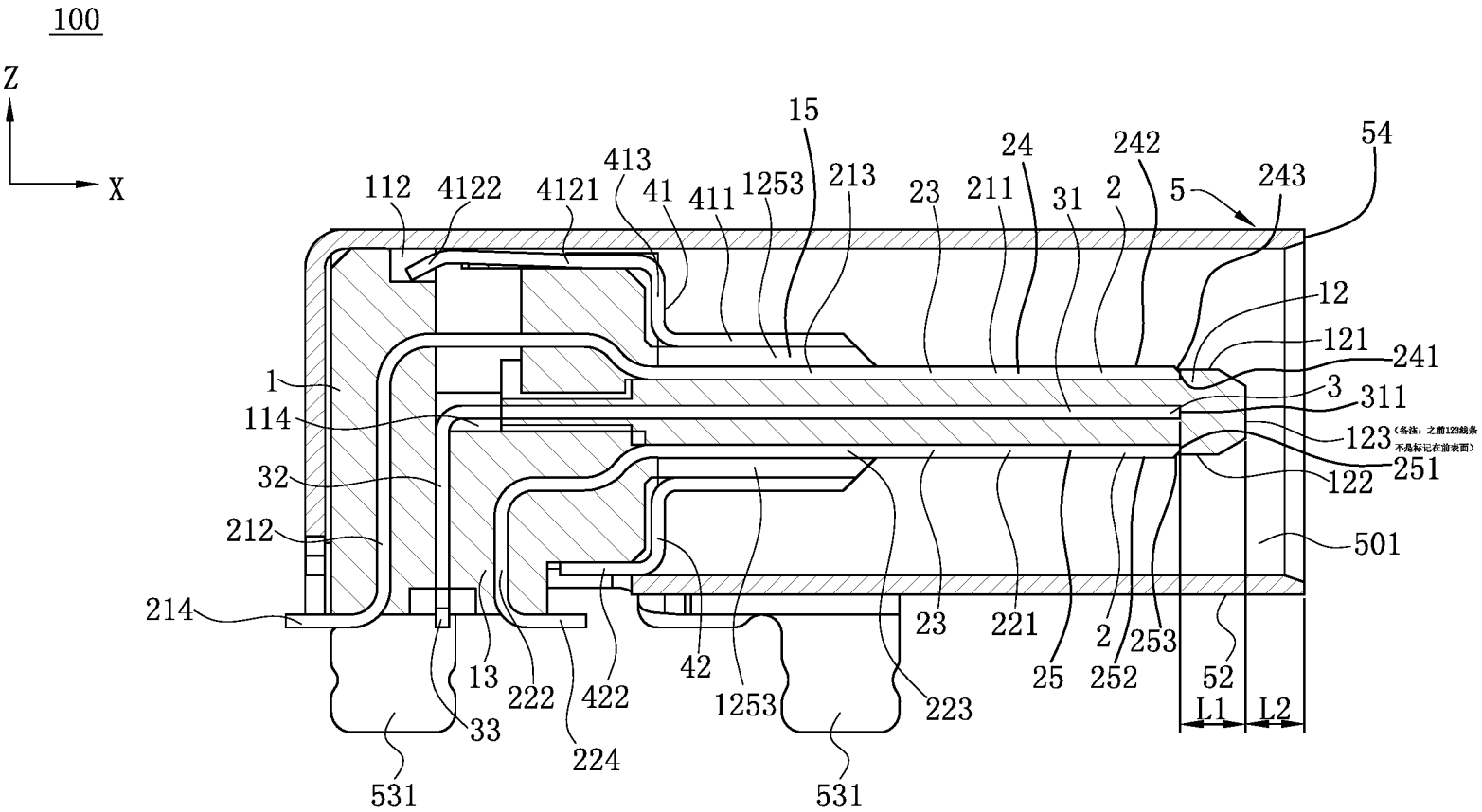
FIG. 4 is a sectional view of the electrical connector according to one embodiment of the present invention.
Figure 5:
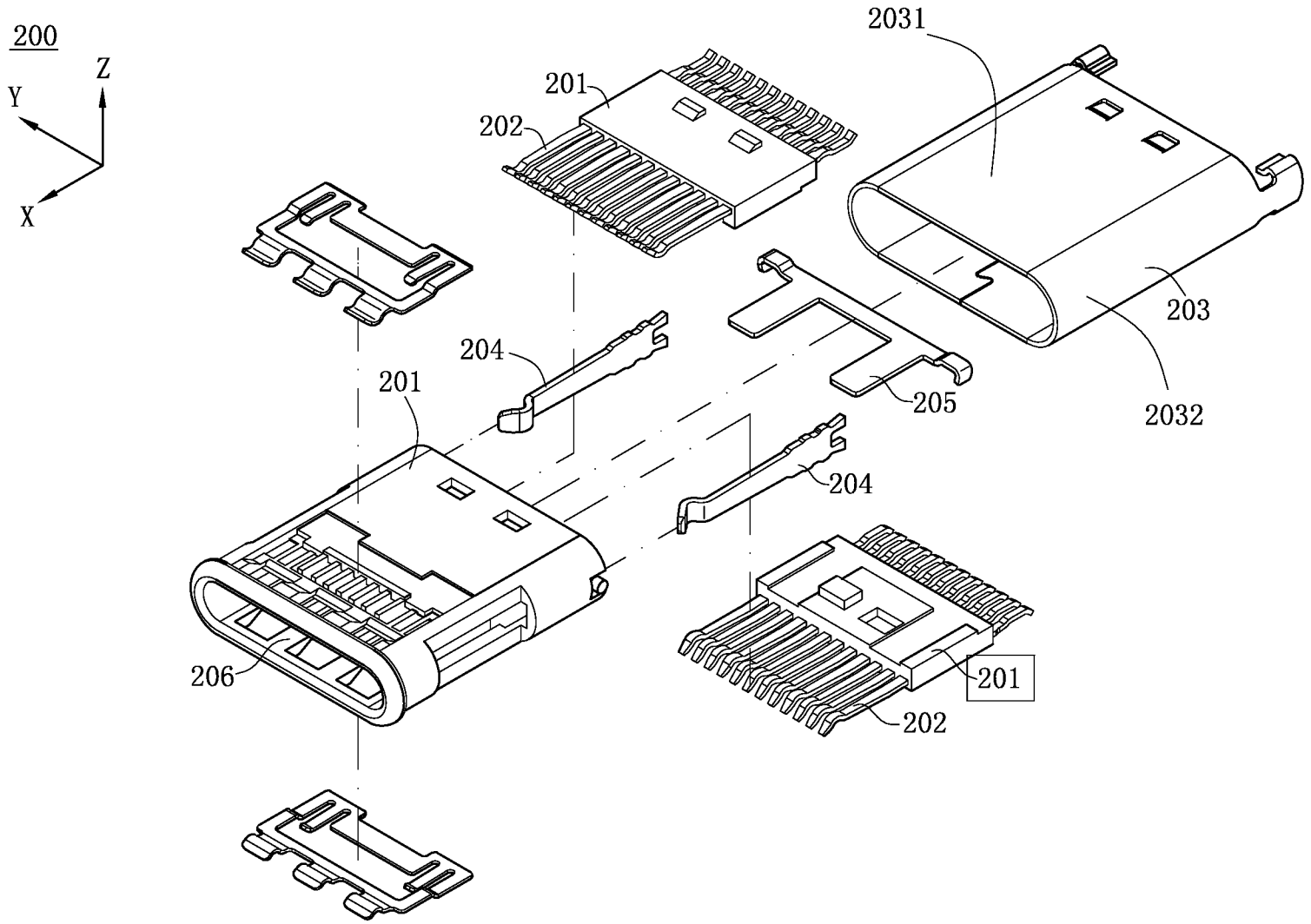
FIG. 5 is a three-dimensional exploded view of a mating connector according to one embodiment of the present invention.

As shown in FIG. 1, FIG. 4 and FIG. 7, a first receiving space 111 is depressed from an upper surface of the base 11 along a vertical direction. Two concave slots 112 are depressed from a rear end of the first receiving space 111. In the vertical direction, a depth of the concave slots 112 is greater than that of the first receiving space 111. The upper surface of the base 11 is further provided with a position limiting slot 113, and the position limiting slot 113 is in communication with a rear end surface of the base 11. A lower surface of the base 11 is provided with a second receiving space 114, and the plastic block 13 is assembled in the second receiving space 114. The tongue 12 has an upper surface 121 and a lower surface 122 opposite to each other vertically, and a front surface 123 and two side surfaces 124 connected between the two surfaces. The upper surface 121 and the lower surface 122 are respectively provided with multiple barriers 125 to form multiple terminal receiving slots 126. Each barrier 125 further includes a front section 1251 and a rear section 1252, and a thickness dimension of the rear section 1252 is greater than that of the front section 1251, to facilitate that the rear section 1252 has a good hot-melting condition when the insulating body 1 is assembled. A latch slot 1241 depressed inward is further formed in a front end of each of the two side surfaces 124. The latch slots 1241 partially accommodate the retaining elastic sheets 204, to enable the retaining elastic sheets 204 to conductively connect the middle grounding sheet 3. A reserving slot 1242 is further formed at a rear end of each of the two side surfaces 1241, for reserving assembly space for the inner metal shell 4.

As shown in FIG. 1, FIG. 2 and FIG. 4, the terminals 2 include a group of upper row terminals 21. The group of upper row terminals 21 includes ten first terminals 24 and two third terminals 26. The upper row terminals 21 are integrally formed with the base 11. Each of the upper row terminals 21 includes a first mating portion 211, a first rear portion 212 and a first connection portion 213 connected between the first mating portion 211 and the first rear portion 212. The first mating portion 211 may extend backward to form the first connection portion 213, the first connection portion 213 may bend downward and extend to form the first rear portion 212 that is vertical, and the first rear portion 212 may bend backward and extend to form a first soldering portion 214 that is horizontal.

As shown in FIG. 1, FIG. 2 and FIG. 4, a group of lower row terminals 22 is provided. The group of lower row terminals 22 includes ten second terminals 25 and two fourth terminals 27. The lower row terminals 22 are integrally formed with the plastic block 13. Each of the lower row terminals 22 includes a second mating portion 221, a second rear portion 222 and a second connection portion 223 connected between the second mating portion 221 and the second rear portion 222. The second mating portion 221 may extend backward to form the second connection portion 223, the second connection portion 223 may bend downward and extend to form the second rear portion 222 that is vertical, and the second rear portion 222 may bend forward and extend to form a second soldering portion 224 that is horizontal. When the base 11, the tongue 12 and the plastic block 13 are assembled together, an upper surface of the rear section 1252 forms a flat plate portion 1253 through hot melting to retain the first connection portion 213, and a lower surface of the rear section 1252 forms the flat plate portion 1253 through hot melting to retain the second connection portion 223, preventing the terminals 2 from tilting outward in the terminal receiving slot 126. The first mating portion 211 is correspondingly received in the terminal receiving slot 126 and exposed to the upper surface 121. The second mating portion 221 is correspondingly received in the terminal receiving slot 126 and exposed to the lower surface 122. The first rear portions 212 and the second rear portions 222 are arranged in two rows.

As shown in FIG. 1, FIG. 2 and FIG. 4, the upper row terminals 21 and the lower row terminals 22 further respectively include two ground terminals 23. In each row, the two ground terminals 23 are located close to the two side surfaces 124. Each of the ground terminals 23 has a protruding portion 231 at a front end thereof, and the protruding portions 231 partially protrude beyond the edges of the tongue 12, avoiding wear to the tongue 12 during mating of the electrical connector 100. The first mating portions 211 and the second mating portions 221 are symmetrically disposed at 180 degrees in the inserting space 501, thus enabling the mating connector 200 to be inserted into the electrical connector 100 in dual orientation. The terminals 2 of each row respectively include, from left to right, a ground terminal 23, a pair of high-speed signal terminals S, a power terminal V, a reserved terminal C, a pair of low-speed signal terminals D, a reserved terminal C, a power terminal V, a pair of high-speed signal terminals S and a ground terminal 23. The ten first terminals 24 are used as the ground terminals 23 in the upper row, the high-speed signal terminals S in the upper row, the low-speed signal terminals D in the upper row and the reserved terminals C in the upper row respectively, and the two third terminals 26 are used as the power terminals V in the upper row. The ten second terminals 25 are used as the ground terminals 23 in the lower row, the high-speed signal terminals S in the lower row, the low-speed signal terminals D in the lower row and the reserved terminals C in the lower row respectively, and the two fourth terminals 27 are used as the power terminals V in the lower row.

As shown in FIG. 1, FIG. 2 and FIG. 4, multiple first terminals 24 and multiple second terminals 25 are fixed in the base 11 in an upper row and a lower row respectively, and exposed to an upper surface 121 and a lower surface 122 of the tongue 12. The first terminals 24 haven two ground terminals 23, and the second terminals 25 have two ground terminals 23. The two ground terminals 23 of the first terminals 24 are located on the upper surface 121 at a location closest to the side surfaces 124, and the other two grounding terminals 23 of the second terminals 25 are located on the lower surface 122 at a location closest to the side surfaces 124.

In this embodiment, each first terminal 24 has a first front edge 241, and each second terminal 25 has a second front edge 251. Each third terminal 26 has a third front edge 261 located behind a corresponding first front edge 241. Each fourth terminal 27 has a fourth front edge 271 located behind a corresponding second front edge 251. The first terminals 24 are adjacent to two sides of each of the third terminals 26, and the second terminals 25 are adjacent to two sides of each of the fourth terminals 27. The first terminals 24 and the second terminals 25 are symmetrically disposed in a vertical direction, and the third terminals 26 and the fourth terminals 27 are symmetrically disposed in the vertical direction, thus enabling the mating connector 200 to be inserted into the electrical connector 100 in dual orientation.

As shown in FIG. 1, FIG. 2 and FIG. 4, each first terminal 24 has a horizontal upper plate surface 242 and a first inclined plane 243, and the first inclined plane 243 is disposed at a location on the upper plate surface 242 close to the upper surface 121. The first inclined plane 243 is connected to the first front edge 241, and a junction between the first inclined plane 243 and the first front edge 241 is lower than the upper surface 121. Each second terminal 25 has a horizontal lower plate surface 252 and a second inclined plane 253, and the second inclined plane 253 is disposed at a location on the lower plate surface 252 close to the lower surface 122. The second inclined plane 253 is connected to the second front edge 251, and a junction between the second inclined plane 253 and the second front edge 251 is higher than the lower surface 122, to prevent the first front edge 241 and the second front edge 251 from scratching the mating connector 200 or the user.

Figure 7A:
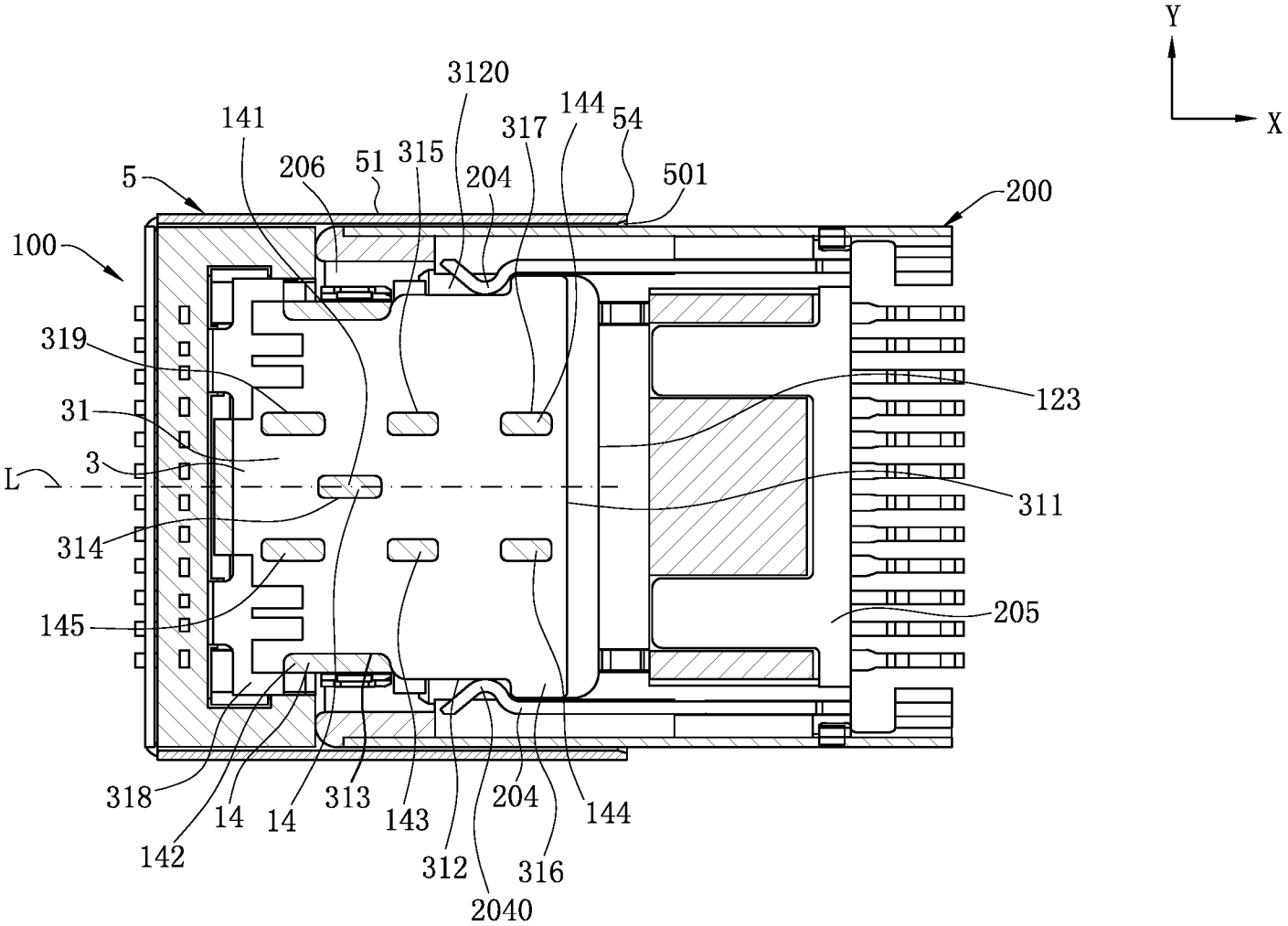
FIG. 7A is a sectional view of the electrical connector according to one embodiment of the present invention when mating with a mating connector.

As shown in FIG. 1, FIG. 4 and FIG. 7A, the middle grounding sheet 3 includes a body portion 31, a vertical portion 32, and multiple grounding pins 33. The body portion 31 is retained into the tongue 12 and located between the upper row terminals 21 and the lower row terminals 22, separates the upper row terminals 21 and the lower row terminals 22, and shields signal interference between the upper row terminals 21 and the lower row terminals 22. The body portion 31 is located between the first terminals 24 and the second terminals 25. The first front edge 241, the second front edge 251 and an edge 311 at a front end of the body portion 31 are located on a same vertical plane. The first front edge 241 and the second front edge 251 are both behind the front surface 123, to prevent the first front edge 241 and the second front edge 251 from scratching the mating connector 200 or the user. The body portion 31 is further partially exposed to the latch slot 1241 and conducted with the retaining elastic sheet 204. The vertical portion 32 is formed by downward extending from a rear end of the body portion 31. The vertical portion 32 is located between the first rear portion 212 and the second rear portion 222, separates the first rear portion 212 and the second rear portion 222, and shields signal interference between the first rear portion 212 and the second rear portion 222. The grounding pins 33 are formed by downward extending from the vertical portion 32, and are configured to be soldered to the grounding circuit of the circuit board (not shown).

As shown in FIG. 1, FIG. 4 and FIG. 7A, each of two sides of the body portion 31 has a side edge 312. The side edges 312 are correspondingly exposed to the tongue 12, and exposed to the latch slots 1241. The side edges 312 are conductively connected with the retaining elastic sheets 204, avoiding that the retaining elastic sheets 204 wear out the latch slots 1241. A notch 313 is concavely provided on each of the two side edges 312, and the notches 313 are correspondingly located in the step portion 15. A width between the two notches 313 is a minimum width of the body portion 31, and the two notches 313 are symmetrical in a left-right direction about a center line L of the middle grounding sheet 3 that extends in a front-rear direction.

Figure 7B:
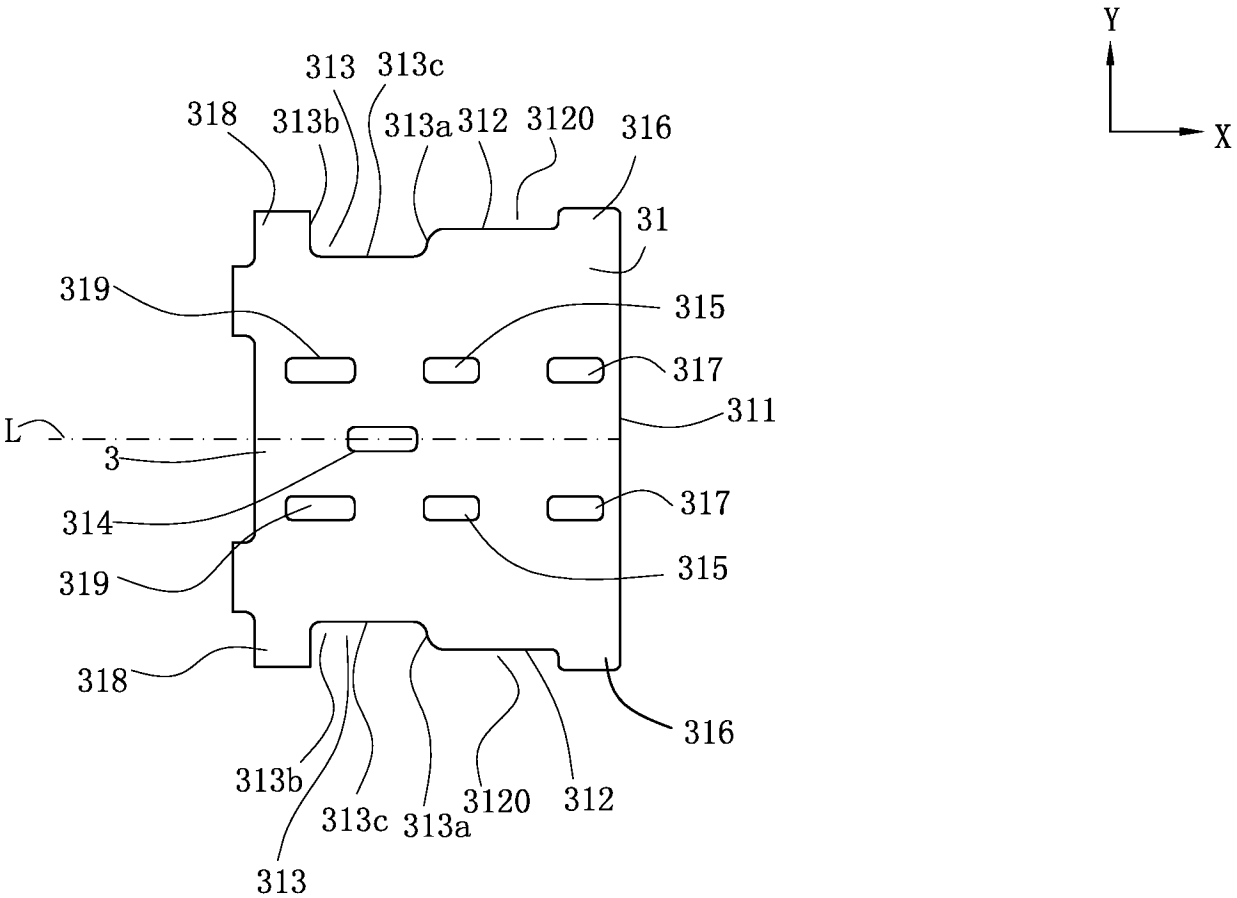
FIG. 7B is a top view of a middle grounding sheet of an electrical connector according to one embodiment of the present invention.

As shown in FIG. 7A and FIG. 7B, a first through hole 314 is disposed between the two notches 313. A length of the notch 313 in the front-rear direction is greater than a length of the first through hole 314 in the front-rear direction. The body portion 31 is provided with two second through holes 315 which are in front of the first through hole 314. A first protruding portion 316 is convexly disposed on each of the two side edges 312 of the body portion 31. The first protruding portions 316 are in front of the notches 313. Each first protruding portion 316 and a corresponding side edge 312 form a latch slot 3120, which is configured to fasten with a corresponding retaining elastic sheet 204. Two third through holes 317 are disposed between the two first protruding portions 316. The second through holes 315 are disposed between the third through holes 317 and the first through hole 314. The first through hole 314, the second through holes 315 and the third through holes 317 are staggered in a front-rear direction, such that the body portion 31 can be fixed into the insulating body 1 in a balanced way. The length of the first through hole 314 along the front-rear direction is greater than the length of each of the second through holes 315 along the front-rear direction and the length of each of the third through holes 317 along the front-rear direction. As the thickness of the base 11 is greater than that of the tongue 12, the length of the first through hole 314 close to the rear is greater than the length of each second through hole 315 and each third through hole 317 close to the front, facilitating flowing-in and fixing of plastics. Each of the two sides of the body portion 31 has a second protruding portion 318 convexly disposed, and each second protruding portion 318 is located behind a corresponding notch 313. Each notch 313 has a first inner edge 313*a* relatively close to a front side of the tongue 12, and the first inner edge 313*a* is adjacent to and connected to the side edge 312 of a corresponding latch slot 3120. Each notch 313 has a second inner edge 313*b* relatively far away from the front side of the tongue 12, and the second inner edge 313*b* is formed by a front edge of the corresponding second protruding portion 318. Each notch 313 has a third inner edge 313*c* connecting the first inner edge 313*a* and the second inner edge 313*b*, and the third inner edge 313*c* is located closer to the center line L of the middle grounding sheet 3 in the front-rear direction than the side edge 312. The latch slot 3120, the notch 313 and the second protruding portion 318 on one side of the body portion 31 are consecutively disposed in the front-rear direction and simply formed. Each second protruding portion 318 is located in the base 11, such that the body portion 31 is stably fixed to the base 11. In this embodiment, two fourth through holes 319 are formed between the two second protruding portions 318, and the fourth through holes 319 are located behind the first through hole 314.

As shown in FIG. 7A and FIG. 7B, when the middle grounding sheet 3 is embedded and formed in the tongue 12, an insulating material forming the insulating body 1 flows into the first through hole 314, the notches 313, the second through holes 315, the third through holes 317 and the fourth through holes 319, and after cooling, the insulating body 1 wraps the middle grounding sheet 3. The insulating material flowing into the first through hole 314 forms a first insulating post 141, and the first insulating post 141 abuts an inner wall of the first through hole 314. The insulating material flowing into each notch 313 forms a corresponding second insulating post 142. Each second insulating post 142 abuts forward the first inner edge 313*a* so as to prevent backward displacement of the middle grounding sheet 3, and abuts backward the second inner edge 313*b* so as to prevent forward displacement of the middle grounding sheet 3, and the two second insulating posts 142 abut the third inner edges 313*c* towards the center line L of the middle grounding sheet 3 so as to prevent displacement of the middle grounding sheet 3 in a left-right direction. The insulating material flowing into each second through hole 315 forms a corresponding third insulating post 143, and the third insulating post 143 abuts an inner wall of each second through hole 315. The insulating material flowing into each third through hole 317 forms a corresponding fourth insulating post 144, and the fourth insulating post 144 abut an inner wall of each third through hole 317. The insulating material flowing into each fourth through hole 319 forms a corresponding fifth insulating post 145, and the fifth insulating post 145 abuts an inner wall of each fourth through hole 319. The first through hole 314 is located between the two notches 313, and the length of the notch 313 in the front-rear direction is greater than the length of the first through hole 314 in the front-rear direction, such that the first insulating post 141 is located between the two second insulating posts 142, and a dimension of each second insulating post 142 in the front-rear direction is larger than a dimension of the first insulating post 141, which may increase an abutting area of the second insulating posts 142 and the middle grounding sheet 3, and thereby may firmly retain the middle grounding sheet 3 in the insulating body 1 and further firmly retain the middle grounding sheet 3 in the electrical connector 100, and avoiding the middle grounding sheet 3 from being displaced in an insertion and extraction process of the electrical connector 100 and the mating connector 200 and not in stable contact with the retaining elastic sheet 204 of the mating connector 200. A good shielding effect is achieved for the upper row terminals 21 and the lower row terminals 22, and high-frequency performance of the electrical connector 100 is improved.

As shown in FIG. 1, FIG. 3 and FIG. 4, the outer metal shell 5 is sleeved outside the base 11 and the tongue 12, and forms an insertion space 501 with the tongue 12. The outer metal shell 5 has a fifth front edge 54. The first terminal 24 and the second terminal 25 are both exposed to the insertion space 501. The outer metal shell 5 includes a top wall 51, a bottom wall 52 and two side walls 53 connecting the top wall 51 and the bottom wall 52. The fifth front edge 54 is disposed at the forefront of the top wall 51, the bottom wall 52 and the two side walls 53. The fifth front edge 54 is forward beyond the front surface 123. There is a first horizontal distance L1 between the first front edge 241 and the front surface 123, there is a second horizontal distance L2 between the front surface 123 and the fifth front edge 54, and the first horizontal distance L1 is equal to the second horizontal distance L2, facilitating that the mating connector 200 is assembled and limited in the insertion space 501, is assembled precisely and may not tilt. The top wall 51 pierces downward corresponding to the position of the position limiting slot 113 to provide an abutting portion 511 abutting an inner wall of the position limiting slot 113, preventing the outer metal shell 5 from moving forward. In other embodiments, the abutting portion 511 may be formed in any other manners, which is not limited herein. A middle portion of each of the side walls 53 extends downward to form a soldering pin 531, a rear end of each of the side walls 53 extends downward to form a soldering pin 531, and the soldering pins 531 are used for being soldered to the circuit board (not shown).

As shown in FIG. 1 and FIG. 4, the inner metal shell 4 is formed by assembling an upper grounding sheet 41 and a lower grounding sheet 42. The upper grounding sheet 41 includes a covering portion 411, an extending portion 412 and a connection portion 413 vertically connecting the covering portion 411 and the extending portion 412. The covering portion 411 covers the flat plate portion 1253. The extending portion 412 covers an upper surface of the base 11 and is received in the first receiving space 111. Each of two sides of the extending portion 412 has a contacting arm 4121 extending backward and upward. The contacting arm 4121 abuts an inner wall of the outer metal shell 5, to from an electrical connection, making the inner metal shell 4 grounded. The end of each contacting arm 4121 bends downward to form a positioning portion 4122, such that the contacting arm 4121 is in an arc shaped contact with the inner wall of the outer metal shell 5, to facilitate assembling of the outer metal shell 5 to the insulating body 1. The positioning portions 4122 are respectively received in the concave slots 112, preventing the inner metal shell 4 from sliding forward. Each of two side walls of the upper grounding sheet 41 is further provided with a mating portion 414, and each of two side walls of the lower grounding sheet 42 is provided with a fixing portion 421 corresponding to the mating portion 414. The mating portion 414 and the fixing portion 412 are accommodated in the reserving slots 1242 correspondingly in a mutually mating manner, such that the inner metal shell 4 wraps the insulating body 1. The lower grounding sheet 42 further has a stopping portion 422. The stopping portion 422 clings to a lower surface of the plastic block 13, to firmly assemble the plastic block 13 to the base 11. In other embodiments, the upper grounding sheet 41 and the lower grounding sheet 42 may be integrally formed, which is not limited herein.

Figure 8:
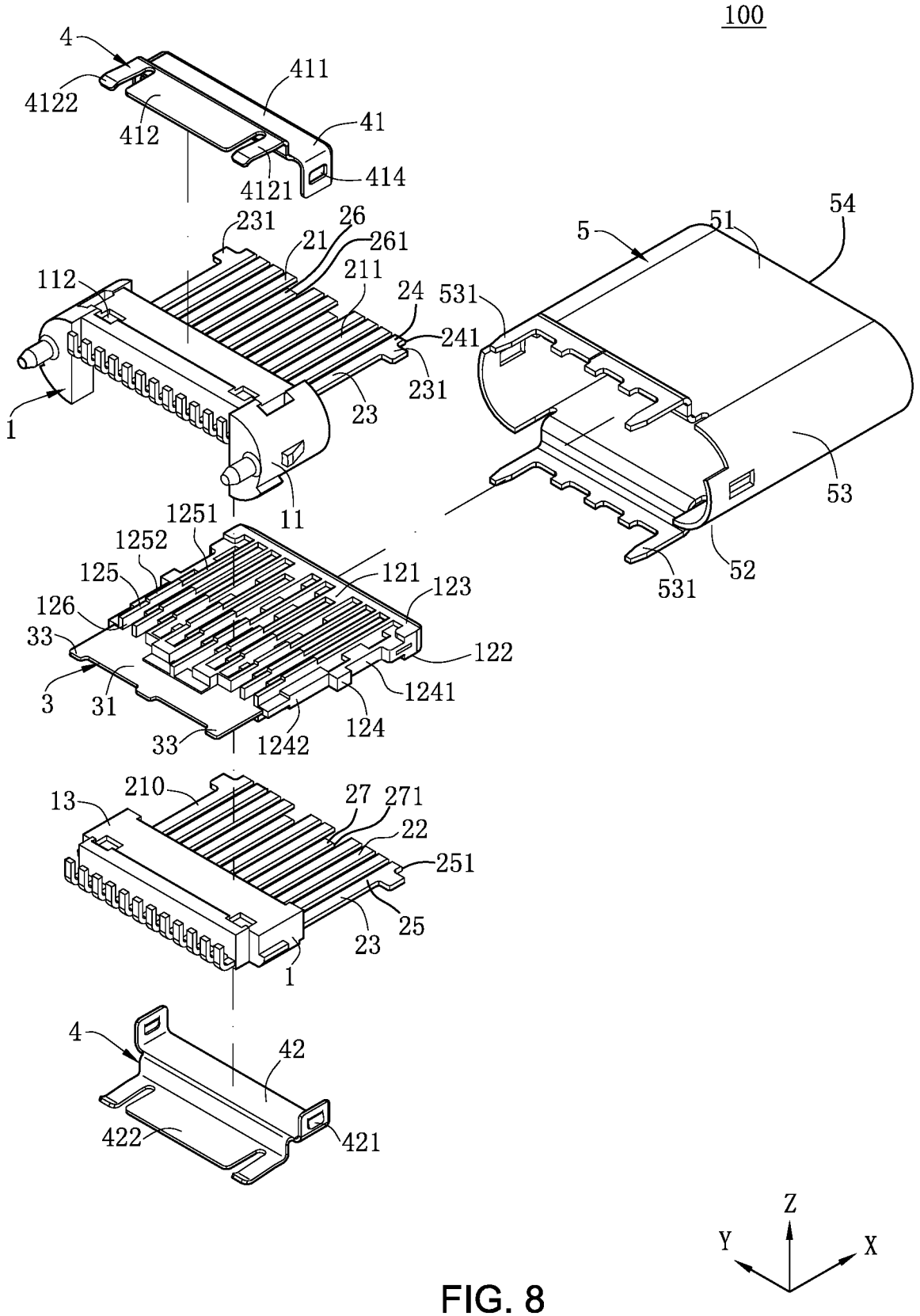
FIG. 8 is a three-dimensional exploded view of an electrical connector according to a second embodiment of the present invention.

FIG. 8 shows an electrical connector 100 according to a second embodiment of the present invention. The second embodiment is different from the first embodiment in that the electrical connector according to the second embodiment is a vertical electrical connector. In this embodiment, the middle grounding sheet 3 is not provided with the vertical portion 32, the grounding pin 33 also extends in a direction directly from the body portion 31 to the circuit board (not shown), and the soldering pins 531 extend from the top wall 51 and the bottom wall 52 toward the circuit board (not shown).

As shown in FIG. 1 and FIG. 2, in the assembly process of the electrical connector 100, firstly, the base 11 and the upper row terminals 21 are integrally formed, the plastic block 13 and the lower row terminals 21 are integrally formed, and the middle grounding sheet 3 is integrally fixed into the tongue 12. Secondly, the tongue 12 is inserted into the base 11 from front to rear, and the plastic block 13 is assembled to the base 11 from bottom to top. Then, the rear section 1252 is correspondingly hot-melted to retain the terminals 2 onto the tongue 12, the upper grounding sheet 41 covers the insulating body 1 downward, and the lower grounding sheet 42 covers the insulating body 1 upward; finally, the outer metal shell 5 is sleeved over the insulating body 1 and correspondingly soldered onto the circuit board (not shown).

FIG. 9 to FIG. 17 show an electrical connector 100 and the mating connector 200 according to a third embodiment of the present invention. The mating connector 200 in the third embodiment is similar to the mating connector 200 in the first embodiment. The insulating body 1 of the electrical connector 100 according to the third embodiment is integrally formed with the terminals 2 and the middle grounding sheet 3. The upper row terminals 2 include eight first terminals 24 and four third terminals 26. The first terminals 24 are used as the high-speed signal terminals S, the low-speed signal terminals D and the reserved terminals C, and the third terminals 26 are used as the ground terminals 23 and the power terminals P. The lower row terminals 22 include eight second terminals 25 and four fourth terminals 27. The second terminals 25 are used as the high-speed signal terminals S, the low-speed signal terminals D and the reserved terminals C, and the fourth terminals 27 are used as the ground terminals 23 and the power terminals P. The first front edge 241 is disposed closely to the rear relative to the third front edge 261 and the second front edge 251 is disposed closely to the rear relative to the fourth front edge 271, to enable the contact terminals 202 to contact the third terminals 26 and the fourth terminals 27 at first to protect the first terminals 24 and the second terminals 25.

Similar to a combining manner for the middle grounding sheet 3 and the insulating body 1 in the first embodiment, the insulating body 1 in this embodiment also has the first insulating post 141 protruding into the first through hole 314, the second insulating posts 142 protruding into the notches 313, the third insulating posts 143 protruding into the second through holes 315 and the fourth insulating posts 144 protruding into the third through holes 317. However, in this embodiment, the first inclined surface 243 and the second inclined surface 253 are embedded into the tongue 12 to better fix the first mating portion 211 and the second mating portion 221.

Figure 9:
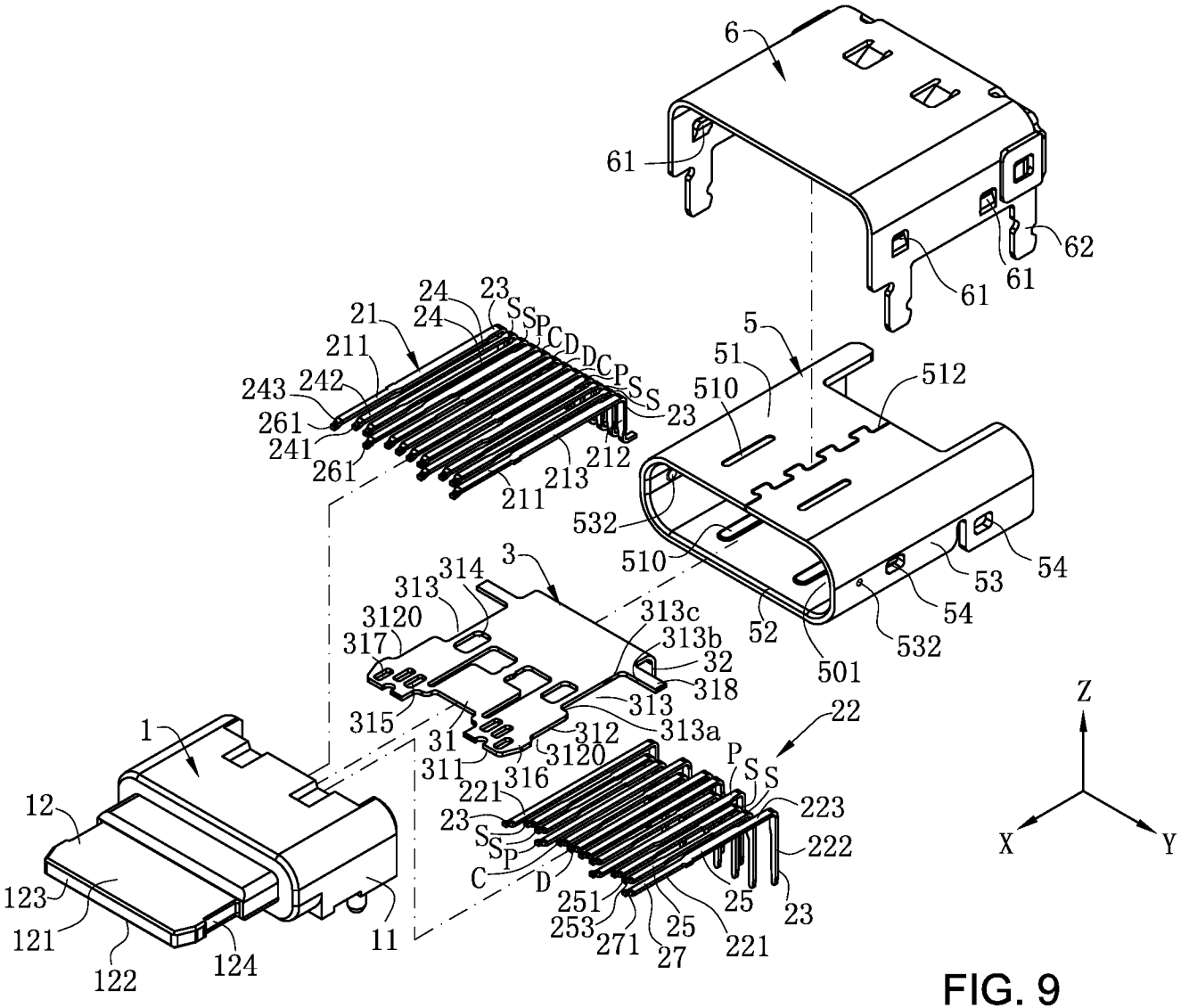
FIG. 9 is a three-dimensional exploded view of an electrical connector according to a third embodiment of the present invention.
Figure 11:
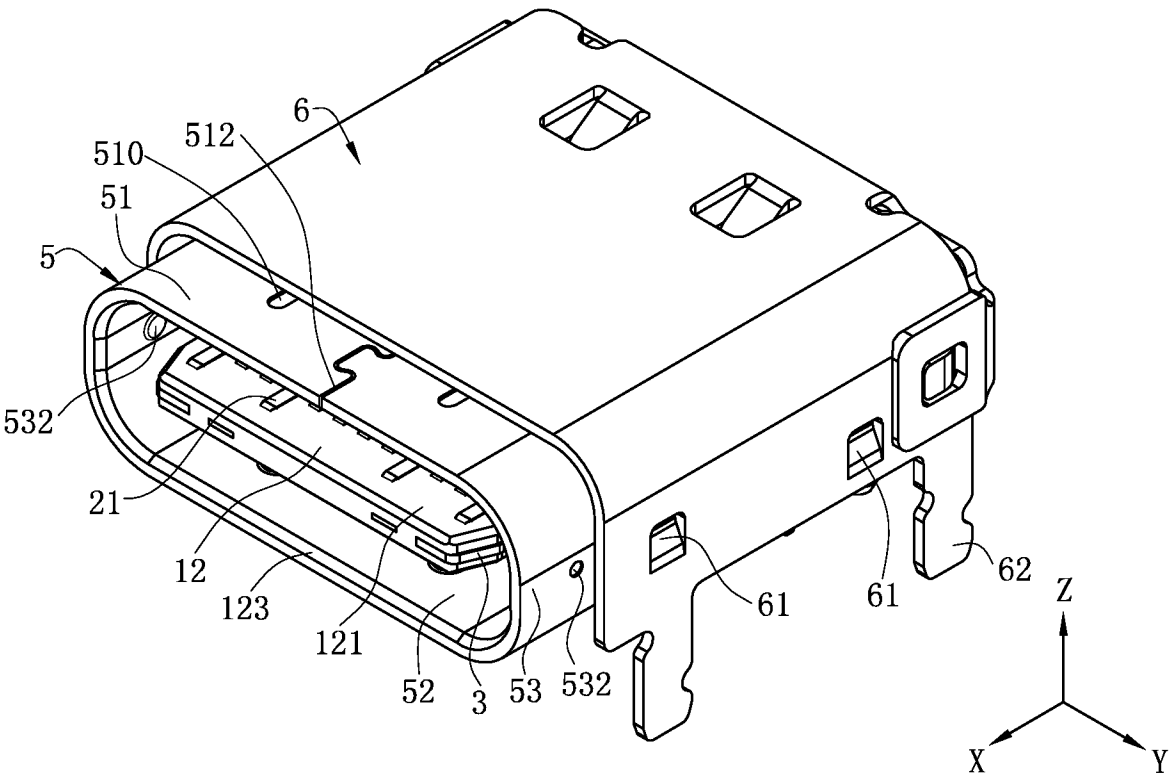
FIG. 11 is an assembly view of the electrical connector according to one embodiment of the present invention.
Figure 12:
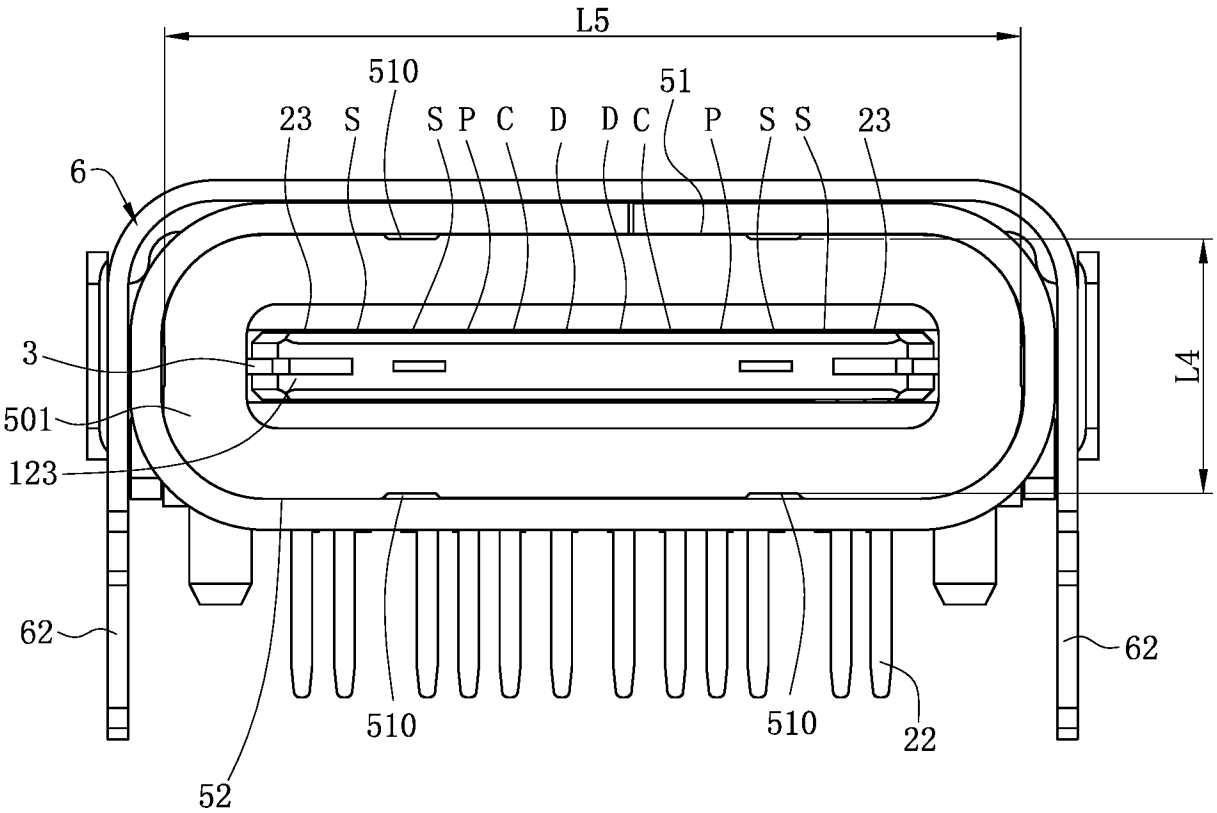
FIG. 12 is a front view of the electrical connector according to one embodiment of the present invention.

In the electrical connector 100 according to the third embodiment, referring to FIG. 9, FIG. 11 and FIG. 12, the outer metal shell 5 wraps a periphery of the insulating body 1, and the outer metal shell 5 is not provided with the soldering pins 531. The outer metal shell 5 has a top wall 51 and a bottom wall 52 disposed opposite to each other, as well as two side walls 53 connecting the top wall 51 and the bottom wall 52. The top wall 51 and the bottom wall 52 are disposed symmetrically vertically relative to a horizontal central plane of the outer metal shell 5. The two side walls 53 are disposed symmetrically left and right relative to a vertical central plane of the outer metal shell 5. An insertion space 501 is formed between the outer metal shell 5 and the tongue 12, and is configured for insertion of the mating connector 200.

Figure 15:
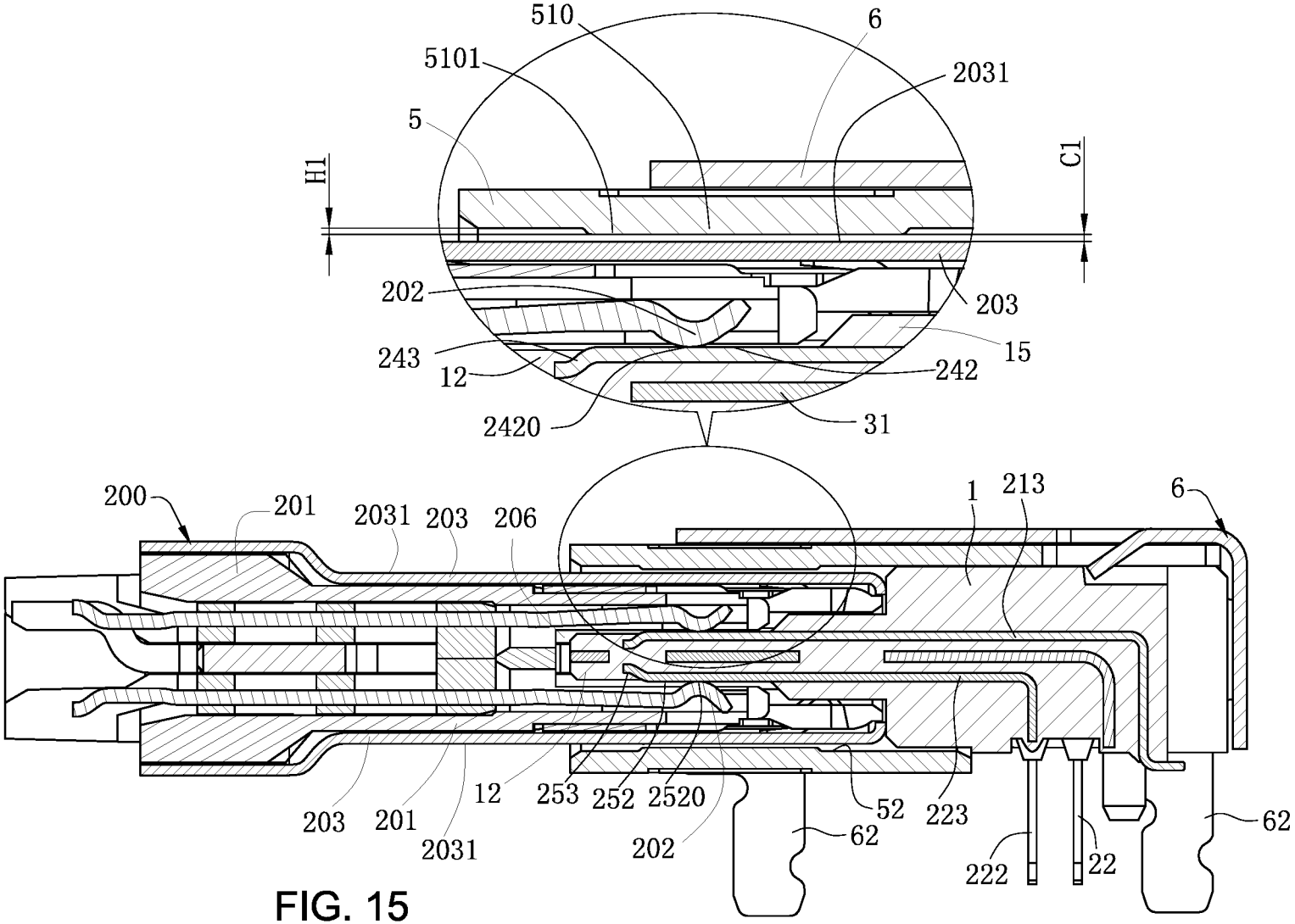
FIG. 15 is a sectional view of the electrical connector according to one embodiment of the present invention after mating with the mating connector.
Figure 16:
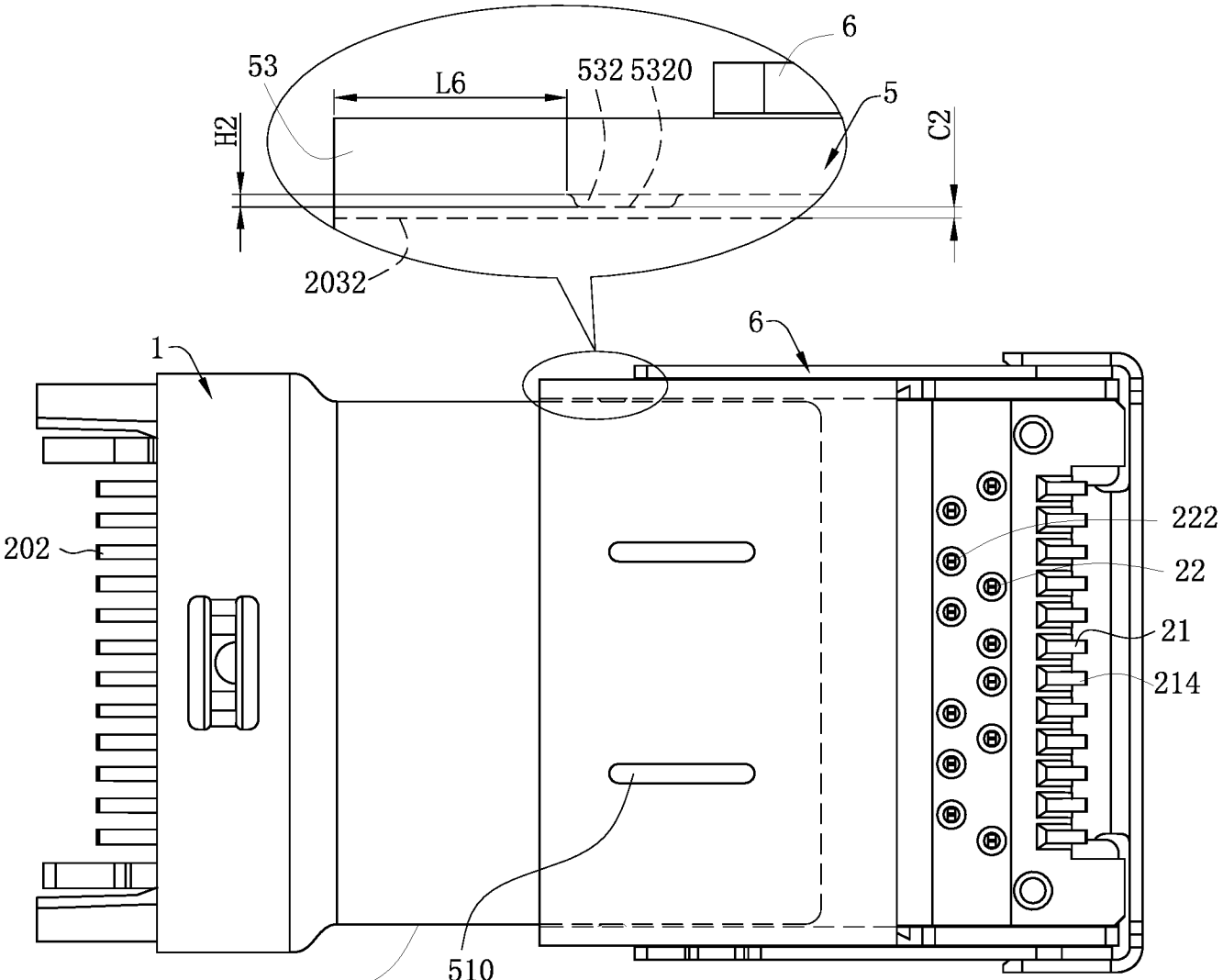
FIG. 16 is a sectional view of the electrical connector according to one embodiment of the present invention after mating with the mating connector from another view angle.

Referring to FIG. 15 and FIG. 16, after the mating connector 200 is inserted into the insertion space 501, the first wall surface 2031 is opposite to the top wall 51, and the second wall surface 2032 is opposite to the side wall 53. Each contact terminal 202 in the upper row electrically abuts the upper plate surface 242 to form a first abutting position 2420, and each contact terminal 202 in the lower row electrically abuts the lower plate surface 252 to form a second abutting position 2520 located on a same vertical plane with the first abutting position 2420. In this embodiment, the retaining elastic sheet 204 is electrically connected with the middle grounding sheet 3, and a connection manner for the two is the same as that for the electrical connector 100 in the first embodiment, and thus will not be elaborated herein.

Figure 17:
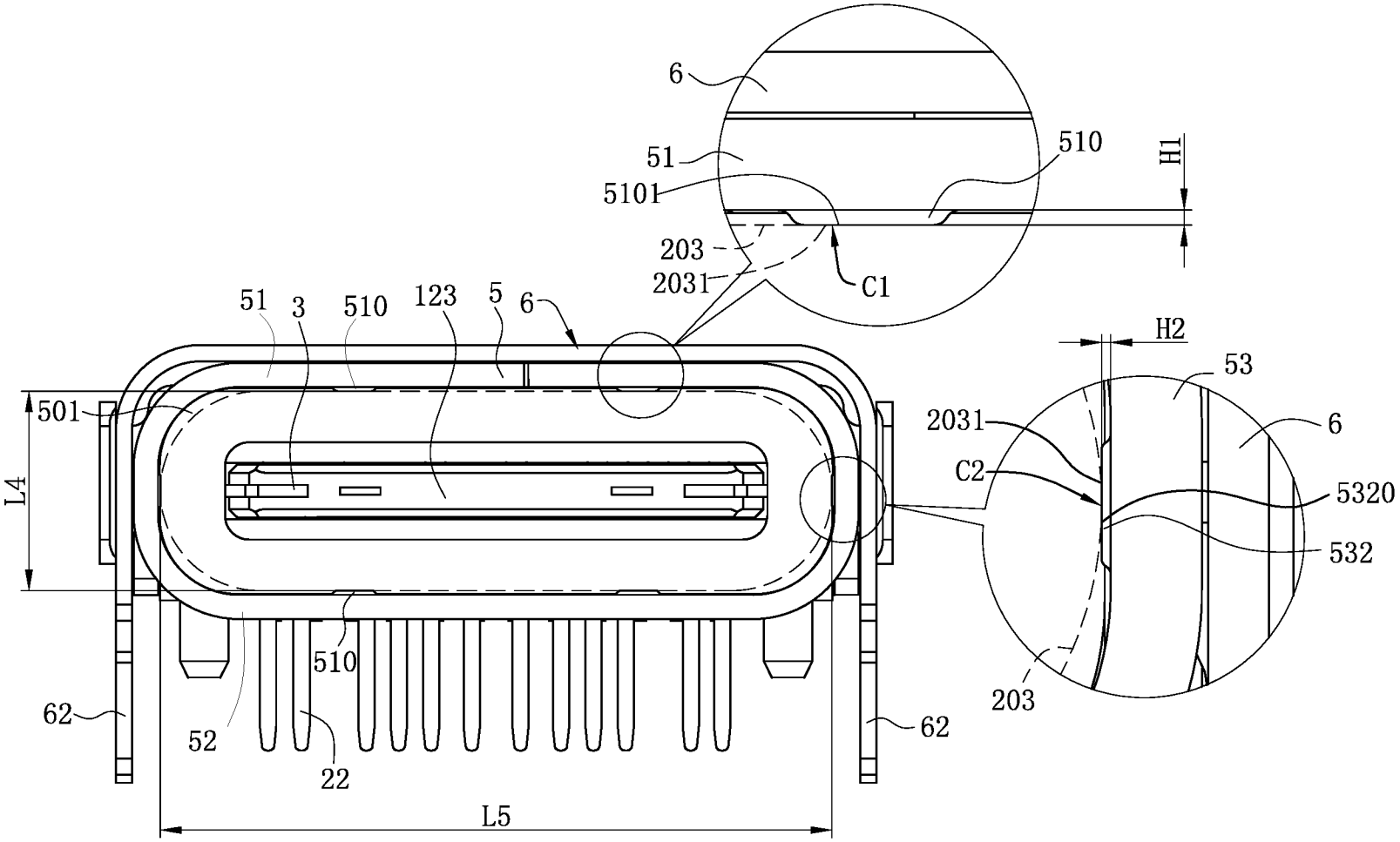
FIG. 17 is a front view of the electrical connector according to one embodiment of the present invention fitted with the mating connector.

Referring to FIG. 9, FIG. 15 and FIG. 16, at least one protruding portion 510 is convexly disposed from the outer metal shell 5 to the insertion space 501. In this embodiment, there are four first protruding portions 510. Each first protruding portion 510 has a first position limiting surface 5101 located at an end of the first protruding portion facing the insertion space 501. Each of the top wall 51 and the bottom wall 52 is provided with two first protruding portions 510 aligned to each other in the vertical direction. The top wall 51 has a seam 512. The two first protruding portions 510 are located on two opposite sides of the seam 512 respectively, and are disposed symmetrically about the seam 512 as a symmetry axis thereto. The first protruding portions 510 located on the top are disposed opposite to the first mating portions 211 of the high-speed signal terminals S in the upper row, and the first protruding portions 510 located on the bottom are disposed opposite to the second mating portions 221 of the high-speed signal terminals S in the lower row. Referring to FIG. 12 and FIG. 17, the first protruding portions 510 on the top wall 51 and the bottom wall 52 are spaced by a fourth distance L4 in the vertical direction, and the fourth distance L4 is more than or equal to 2.43 mm and less than or equal to 2.51 mm.

In another embodiment, there may be only one first protruding portion 510, which is disposed at a central position of the bottom wall 52. In other embodiments, there may be two first protruding portions 510, and the two first protruding portions 510 are simultaneously disposed on the top wall 51 or the bottom wall 52. Each of the top wall 51 and the bottom wall 52 is provided with at least one first protruding portion 510.

Referring to FIG. 15, FIG. 16 and FIG. 17, each first protruding portion 510 has a first height H1 in the vertical direction, and the first height H1 is more than or equal to 0.042 mm and less than or equal to 0.08 mm. In another embodiment, the first height H1 may be more than or equal to 0.05 mm and less than or equal to 0.08 mm. In other embodiments, the first height H1 may be more than or equal to 0.04 mm and less than or equal to 0.07 mm. When the first height H1 is 0.042 mm, a first clearance C1 formed between the first position limiting surface 5101 and the first wall surface 2031 is 0.0449 mm. When the first height H1 is 0.08 mm, the first clearance C1 formed between the first position limiting surface 5101 and the first wall surface 2031 is equal to 0.001 mm. Namely, the first clearance C1 is almost zero. That is, when the first height H1 is more than or equal to 0.02 mm and less than or equal to 0.08 mm, the first clearance C1 formed between the first position limiting surface 5101 and the first wall surface 2031 may be controlled within a range of 0.001 mm to 0.059 mm, such that the fit clearance in the vertical direction is reduced during insertion of the mating connector 200 and the electrical connector 100, an vertical shake amplitude of the mating connector 200 in the insertion space 501 is reduced, the mating connector 200 may mate with the electrical connector 100 firmly, and stable electrical contact between the electrical connector 100 and the mating connector 200 is ensured. Moreover, the first height H1 of the first protruding portion 510 in the vertical direction is more than or equal to 0.042 mm and less than or equal to 0.08 mm. Such a setting about the height dimension of the first protruding portion 510 enables a proper fit clearance between the shielding casing 203 of the mating connector 200 and the outer metal shell 5, and effectively reduces the degree of wear of the shielding casing 203 of the mating connector 200, thereby avoiding influence on the appearance and electrical performance of the shielding casing 203 and making the mating connector 200 easy to insert and extract.

Before and after the mating connector 200 is inserted into the insertion space 501, the first height H1 remains unchanged. If the first height H1 changes in an insertion process of the mating connector 200, the mating connector 200 may shake in the vertical direction along with change of the first height H1. In this embodiment, the first height H1 remains unchanged to reduce shakes in the vertical direction in the insertion process of the mating connector 200. Moreover, the middle grounding sheet 3 is electrically connected with the retaining portion 2040. In consideration of a stamping procedure and miniaturization of the electrical connector 100, the thickness of the middle grounding sheet 3 in the vertical direction should not be excessively large, such that the shakes of the mating connector 200 in the vertical direction may be reduced, and a shake amplitude of the retaining portion 2040 in the vertical direction may be reduced. Since the first insulating post 141 and the second insulating post 142 may act to firmly retain the middle grounding sheet 3 in the insulating body 1, an electrical conduction effect for the retaining portion 2040 and the middle grounding sheet 3 is stable.

Referring to FIG. 15, FIG. 16 and FIG. 17, the first protruding portion 510 is strip shaped, extends forward beyond the upper plate surface 242 of the high-speed signal terminal S in the upper row and the lower plate surface 252 of the high-speed signal terminal S in the lower row, and extends backward beyond the first abutting position 2420 and the second abutting position 2520, such that in the process where the contact terminal 202 in the upper row starts abutting the upper plate surface 242 to reach the first abutting position 2420 and the contact terminal 202 in the lower row reaches the second abutting position 2520, the first protruding portion 510 keeps a position limiting action in the vertical direction on the first wall surface 2031, which reduces shakes of the electrical connector 100 in the vertical direction, enables good mating stability between the contact terminals 202 and the high-speed signal terminals S, and further facilitates a high-frequency property of the electrical connector 100.

Figure 13:
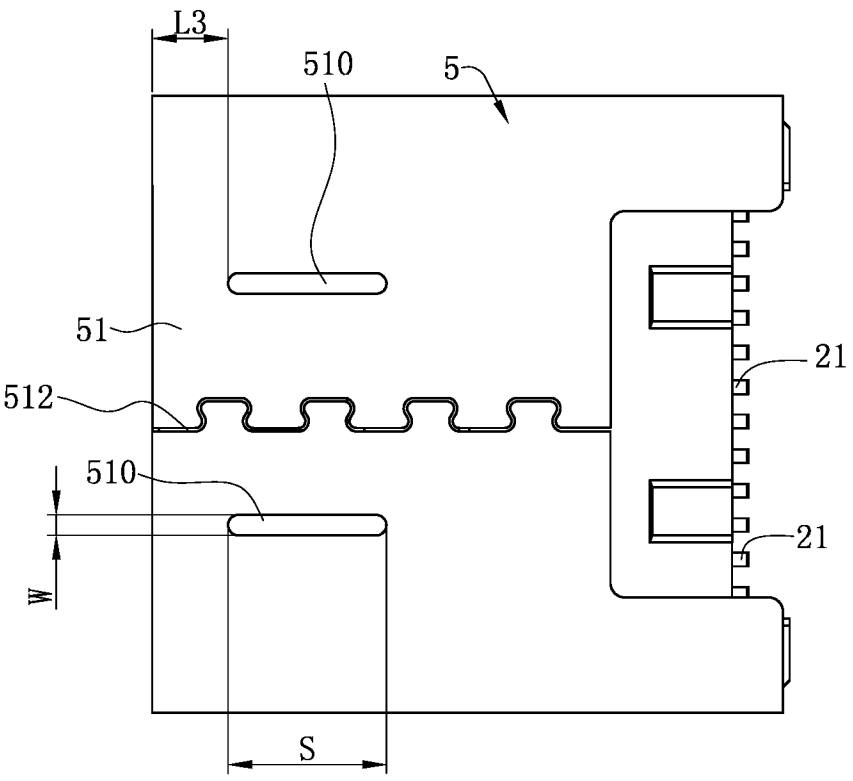
FIG. 13 is a top view of the electrical connector according to one embodiment of the present invention.
Figure 14:
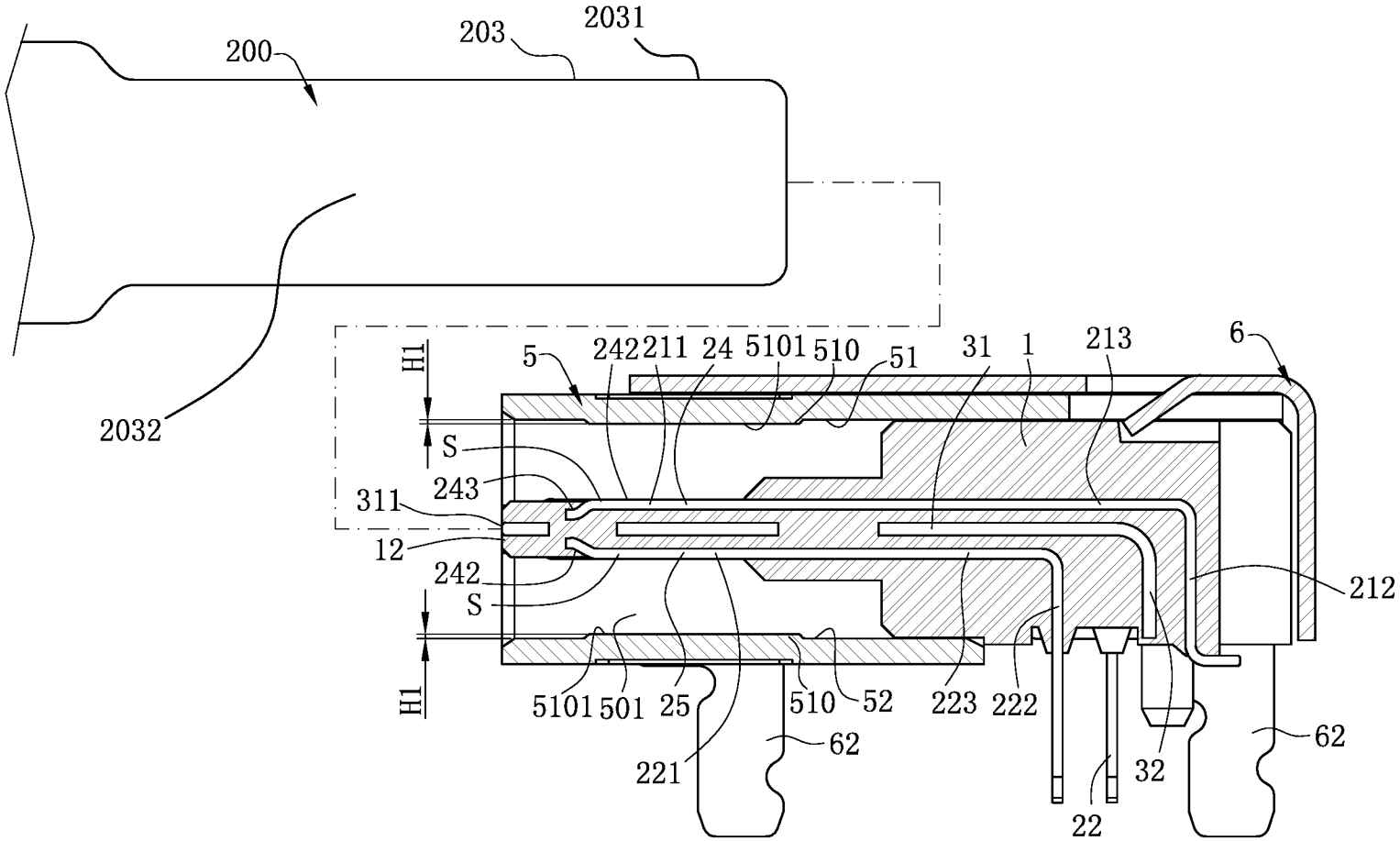
FIG. 14 is a sectional view of the electrical connector according to one embodiment of the present invention before mating with a mating connector.

Referring to FIG. 12 and FIG. 13, a length S of the first protruding portion 510 in the front-rear direction is more than or equal to a material thickness of the outer metal shell 5, and a width W of the first protruding portion 510 in a transverse direction perpendicular to the front-rear direction is more than or equal to the material thickness of the outer metal shell 5. Such settings about the length dimension S and width dimension W of the first protruding portion 510 make the first protruding portion 510 easy to stamp and form, and solve the problem that a relatively thin punch being used in a stamping forming process is easy to break and further requires to be frequently replaced, thereby saving the manufacturing time and reducing the manufacturing cost. There is a third distance L3 between a front end edge of the first protruding portion 510 and the front edge of the outer metal shell 5, and the third distance L3 is more than or equal to four times of the material thickness of the outer metal shell 5. Such a setting about the third distance L3 makes it convenient to stamp and form the first protruding portion 510, avoids a frame opening of the outer metal shell 5 from being too close to the first protruding portion 510, and avoids the frame opening of the outer metal shell 5 from being deformed to further affect insertion of the mating connector 200 in the stamping process of the first protruding portion 510. Each of the top wall 51 and the bottom wall 52 is provided with two first protruding portions 510, each side wall 53 is arc-shaped, and a junction of the sidewall 53 and each of the top wall 51 and the bottom wall 52 has a border line (not numbered).

Referring to FIG. 9, FIG. 16 and FIG. 17, at least one second protruding portion 532 is convexly disposed from each side wall 53 to the insertion space 501. In this embodiment, each side wall 53 is provided with one second protruding portion 532, and an end of the second protruding portion 532 facing the insertion space 501 forms a second position limiting surface 5320 for limiting the shielding casing 203. In other embodiments, each side wall 53 may be provided with multiple second protruding portions 532. The second protruding portion 532 has a second height H2 in the transverse direction perpendicular to the front-rear direction and the vertical direction, and the second height H2 is more than or equal to 0.01 mm and less than or equal to 0.06 mm. When the second height H2 is equal to 0.01 mm, a second clearance C2 formed between the second position limiting surface 5320 and the second wall surface 2032 is 0.045 mm. When the second height H2 is equal to 0.06 mm, the second clearance C2 formed between the second position limiting surface 5320 and the second wall surface 2032 is 0 mm. Namely, there is no clearance. That is, when the second height H2 is more than or equal to 0.01 mm and less than or equal to 0.05 mm, the second clearance C2 formed between the second position limiting surface 5320 and the second wall surface 2032 may be controlled within a range of 0 mm to 0.045 mm, such that the second clearance C2 for mating of the shielding casing 203 of the mating connector 200 and the outer metal shell 5 in the transverse direction is reduced during insertion of the mating connector 200 and the electrical connector 100, the vertical shake amplitude of the mating connector 200 in the insertion space 501 is reduced, the mating connector 200 may mate with the electrical connector 100 firmly, and stable electrical contact between the electrical connector 100 and the mating connector 200 is ensured. Moreover, there is no interference to mating, so that the mating connector 200 is easy to insert and extract.

In this embodiment, the second height H2 is more than or equal to 0.01 mm and less than or equal to 0.05 mm. In other embodiments, the second height H2 may be more than or equal to 0.03 mm and less than or equal to 0.06 mm. There is a fifth distance L5 between the two second protruding portions 532, and the fifth distance L5 is more than or equal to 8.28 mm and less than or equal to 8.31 mm. There is a sixth distance L6 between a front end edge of the second protruding portion 532 and the front edge of the outer metal shell 5, and the sixth distance L6 is more than or equal to four times of the material thickness of the outer metal shell 5. Such a setting about the sixth distance L6 facilitates stamping forming of the second protruding portion 532, avoids the frame opening of the outer metal shell 5 from being too close to the second protruding portion 532, and avoids the frame opening of the outer metal shell 5 from being deformed to further affect insertion of the mating connector 200 in a stamping process of the second protruding portion 532. The second protruding portion 532 is round, and a diameter of the second protruding portion 532 in the front-rear direction is more than or equal to the material thickness of the outer metal shell 5, so that stamping forming is facilitated.

Figure 10:
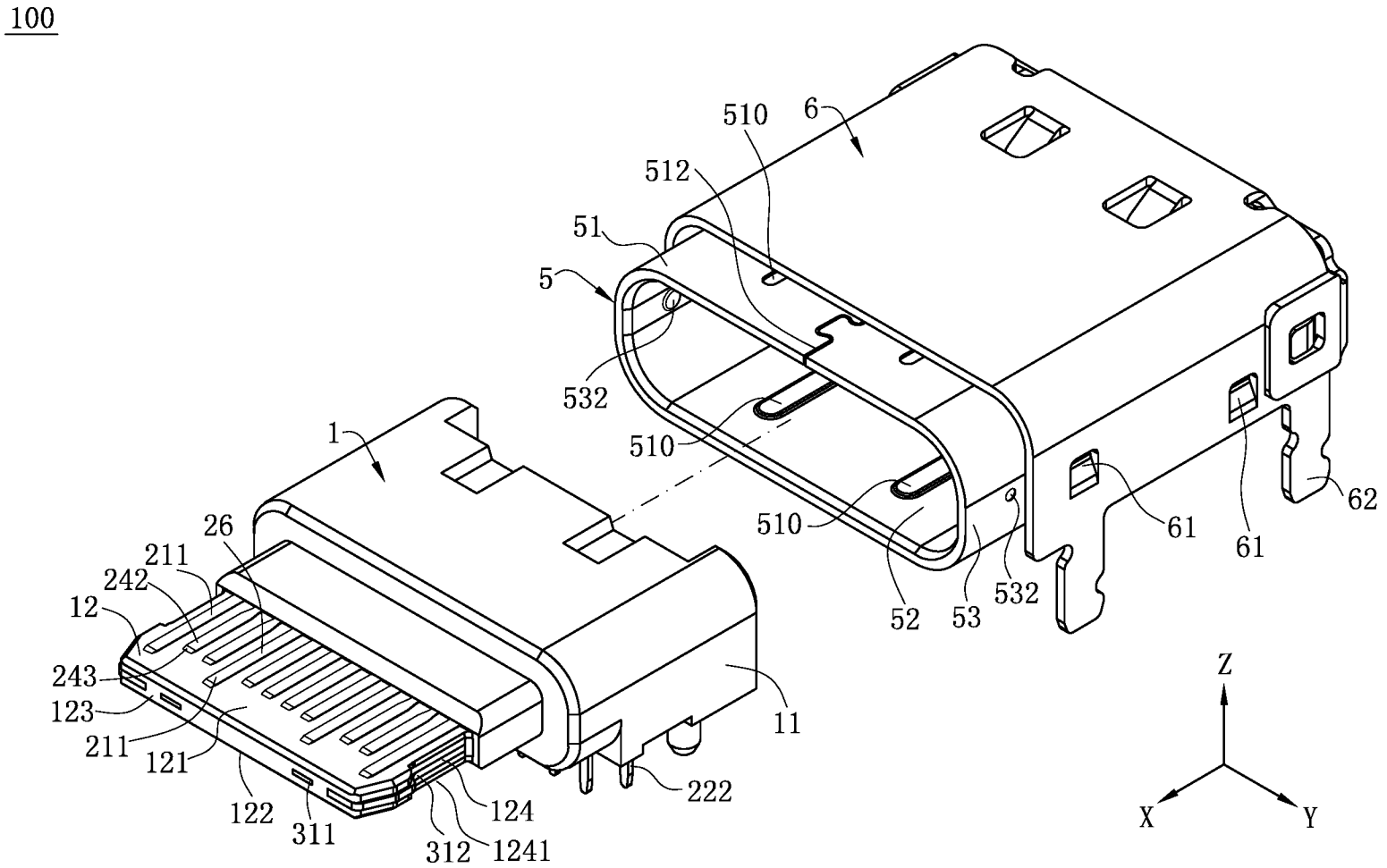
FIG. 10 is a partial assembly view of the electrical connector according to one embodiment of the present invention.

Referring to FIG. 9, FIG. 10 and FIG. 11, the electrical connector 100 is further provided with a masking metal shell 6, and the masking metal shell 6 wraps the periphery of the outer metal shell 5 and shields the seam 512. A bayonet 54 is formed in each of two sides of the outer metal shell 5, and the second protruding portions 532 are located on front sides of the bayonets 54. An elastic sheet retaining sheet 61 is disposed on each of two sides of the masking metal shell 6, and the elastic sheet retaining sheets 61 are clamped in the bayonets 54, to fix the outer metal shell 5 together with the masking metal shell 6. The masking metal shell 6 and the outer metal shell 5 are structurally complementary, such that a shielding effect and strength of the electrical connector 100 may be improved. Two pins 62 extend downward from each of two sides of the masking metal shell 6 for soldering and fixing to the circuit board, and the outer metal shell 5 is not provided with the soldering pins 531.

Figure 18:
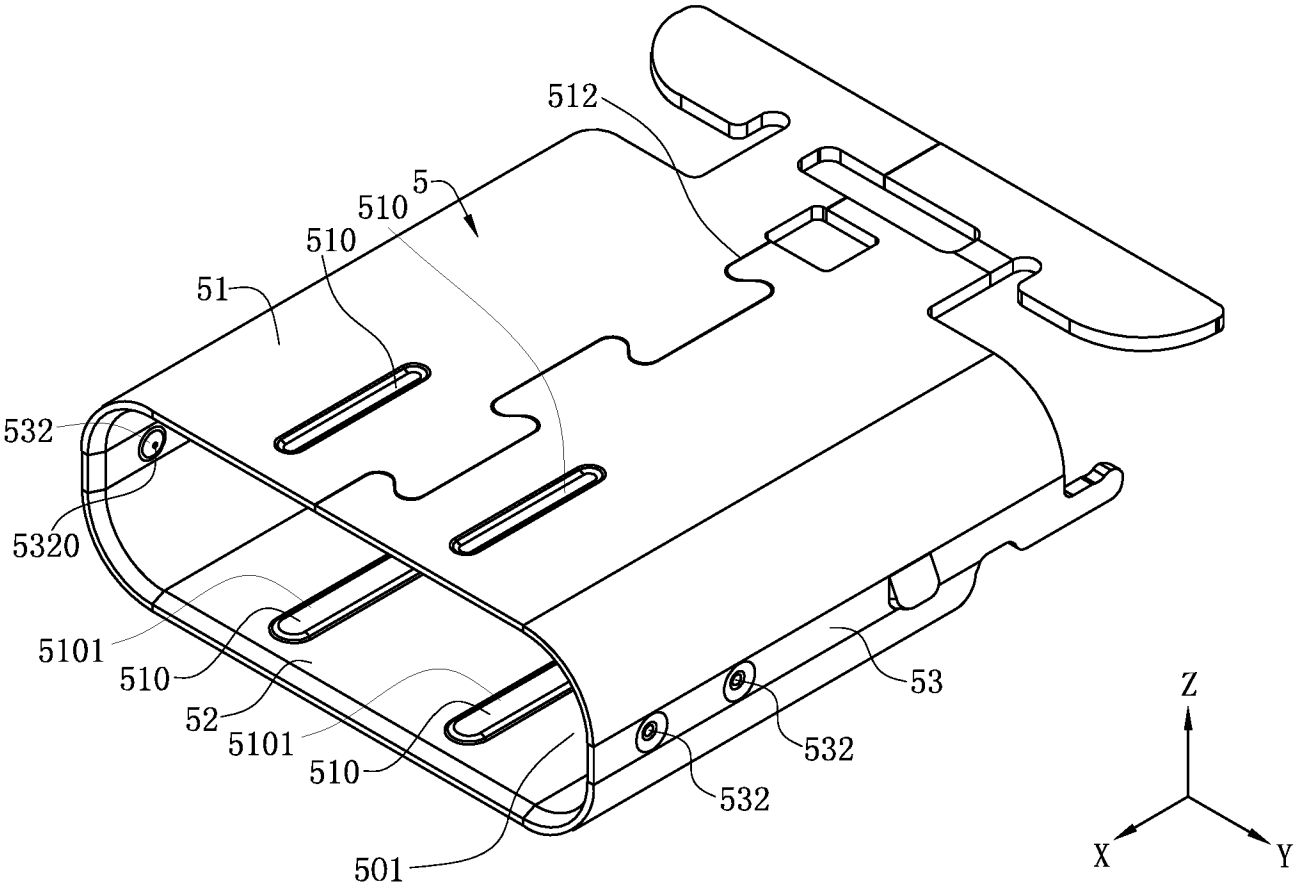
FIG. 18 is a structural schematic view of a metal shell according to a fourth embodiment of the present invention.
Figure 19:
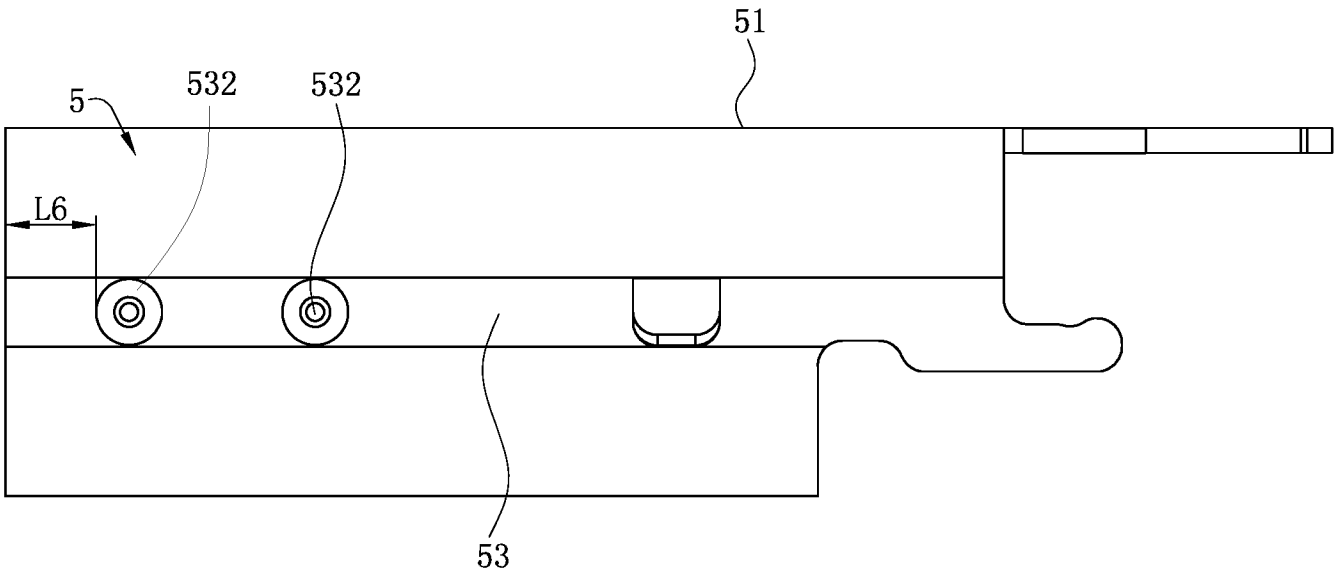
FIG. 19 is a side view of FIG. 18.
Figure 20:
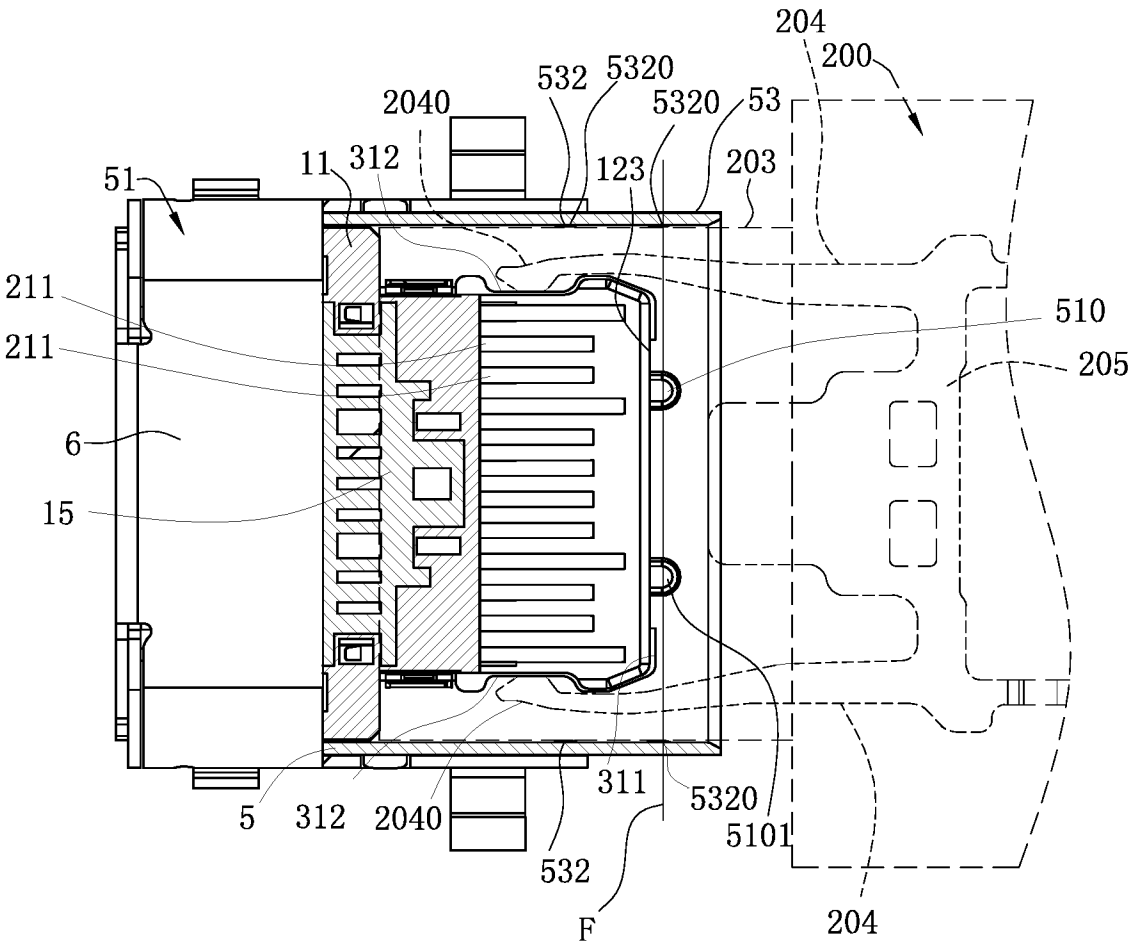
FIG. 20 is a schematic view of the electrical connector of the fourth embodiment of the present invention mated with the mating connector.

FIG. 18, FIG. 19 and FIG. 20 show an electrical connector 100 according to a fourth embodiment of the present invention. In this embodiment, the mating connector 200 is similar to the mating connector 200 in the first embodiment, and is different in that the retaining elastic sheet 204 of the mating connector 200 is integrally formed with the middle shielding sheet 205. The retaining portion 2040 is electrically connected with the middle grounding sheet 3, and a connection manner for the two is the same as that for the electrical connector 100 in the first embodiment and thus will not be elaborated herein. The first protruding portion 510 extends forward beyond the front surface 123 and the edge 311, and the edge 311 is located in front of the front surface 123, thereby reducing wear of the front surface 123 in the process of butting the mating connector 200. Each side wall 53 has two second protruding portions 532 disposed in the front-rear direction, and the second protruding portions 532 of the two side walls 53 are disposed opposite to each other in the left-right direction. After the retaining elastic sheet 204 abuts the side edge 312, the retaining elastic sheet 204 is partially located between the front second protruding portion 532 and the corresponding side edge 312, thereby facilitating electrical abutting of the retaining elastic sheet 204 and the side edge 312 in the left-right direction. A first vertical surface F passes through the two first position limiting surfaces 5101 opposite to each other vertically and the second position limiting surface 5320 relatively close to the insertion space 501, and the front surface 123 and the edge 311 are both located behind the first vertical surface F. When the mating connector 200 is inserted into the insertion space 501, the mating connector 100 passes through the first vertical surface F at first to reduce shakes of the mating connector 200 in the vertical direction and the left-right direction and result in stability of the insertion process of the electrical connector 100 and the mating connector 200, then passes through the edge 311 to prevent the edge 311 from scratching the mating connector 200 during improper mating, and finally mates with the tongue 12 to achieve a stable mating effect, a good positioning effect and favorability for high-frequency transmission performance of the electrical connector 100 and the mating connector 200.

To sum up, the electrical connector 100 according to certain embodiments of the present invention has the following beneficial effects.

(1) The first insulating post 141 is located between the two second insulating posts 142, and a dimension of each second insulating post 142 in the front-rear direction is larger than a dimension of the first insulating post 141, which may increase an abutting area of the second insulating posts 142 and the middle grounding sheet 3, and thereby may firmly retain the middle grounding sheet 3 in the insulating body 1 and further firmly retain the middle grounding sheet 3 in the electrical connector 100, and avoiding the middle grounding sheet 3 from being displaced in an insertion and extraction process of the electrical connector 100 and the mating connector 200. The first clearance C1 formed between the first position limiting surface 5101 and the first wall surface 2031 may be controlled within a range of 0.001 mm to 0.059 mm, such that the fit clearance in the vertical direction is reduced during insertion of the mating connector 200 and the electrical connector 100, an vertical shake amplitude of the mating connector 200 in the insertion space 501 is reduced, the mating connector 200 may mate with the electrical connector 100 firmly, and the vertical shake amplitude of the retaining portion 2040 in the insertion space 501 is also reduced. In the electrical connector 100 according to certain embodiments of the present invention, the displacement of the middle grounding sheet 3 is avoided, and the vertical shake amplitude of the retaining portion 2040 in the insertion space 501 is reduced, thus ensuring the electrical abutting between the retaining elastic sheet 204 and the middle grounding sheet 3.

(2) The first protruding portion 510 is strip shaped, extends forward beyond the upper plate surface 242 of the high-speed signal terminal S in the upper row and the lower plate surface 252 of the high-speed signal terminal S in the lower row, and extends backward beyond the first abutting position 2420 and the second abutting position 2520, such that in the process where the contact terminal 202 in the upper row starts abutting the upper plate surface 242 to reach the first abutting position 2420 and the contact terminal 202 in the lower row reaches the second abutting position 2520, the first protruding portion 510 keeps a position limiting action in the vertical direction on the first wall surface 2031, which reduces shakes of the electrical connector 100 in the vertical direction, enables good mating stability between the contact terminals 202 and the high-speed signal terminals S, and further facilitates a high-frequency property of the electrical connector 100.

(3) When the mating connector 200 is inserted into the insertion space 501, the mating connector 100 passes through the first vertical surface F at first to reduce shakes of the mating connector 200 in the vertical direction and the left-right direction and result in stability of the insertion process of the electrical connector 100 and the mating connector 200, then passes through the edge 311 to prevent the edge 311 from scratching the mating connector 200 during improper mating, and finally mates with the tongue 12 to achieve a stable mating effect, a good positioning effect and favorability for high-frequency transmission performance of the electrical connector 100 and the mating connector 200.

(4) The upper grounding sheet 41 has the extending portion 412 covering an upper surface of the base 11, and the lower grounding sheet 42 has the stopping portion 422 clinging to a lower surface of the plastic block 13, which increases coverage of the inner metal shell 4, more effectively prevents crosstalk caused by that electromagnetic radiation in the insertion space 501 leaks backward to interfere tails of the terminals 2 during high-speed signal transmission of the electrical connector 100, and improves signal transmission quality of the electrical connector 100.

(5) The middle grounding sheet 3 has the vertical portion 32 located between the first rear portion 212 and the second rear portion 222, which effectively shields telecommunication interference between the first rear portions 212 and the second rear portions 222, and enhances signal transmission stability of the electrical connector 100.

(6) The insulating body 1 is formed by assembling the base 11, the tongue 12 and the plastic block 13, which reduces the difficulty of integrally forming the insulating body 1, improves the manufacturing speed of the insulating body 1, and saves the manufacturing cost of the electrical connector 100.

(7) During assembly, the tongue 12 adopts a hot melting method to retain the terminals 2, which makes the terminals 2 unlikely to tilt upward on the tongue 12, and prolongs the service life of the electrical connector 100.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, configured for a mating connector to be inserted thereto, the mating connector having a plastic body and a shielding casing wrapping the plastic body, the shielding casing having a first wall surface and a second wall surface connected with the first wall surface, and the electrical connector comprising:

an insulating body, having a base and a tongue provided at a front end of the base;

a plurality of terminals, formed in an upper row and a lower row, and respectively arranged on an upper surface and a lower surface of the tongue;

a middle grounding sheet, provided in the base and extending to the tongue, wherein the middle grounding sheet is located between the terminals in the upper row and the terminals in the lower row, the middle grounding sheet is provided with at least one first through hole, the middle grounding sheet has two latch slots and two notches concavely provided inward at a left side and a right side of the middle grounding sheet, each of the notches is located behind and adjacent to and connected to a corresponding one of the latch slots, the first through hole is located between the two notches, the insulating body has a first insulating post entering the first through hole and two second insulating posts correspondingly entering the notches, and a dimension of the second insulating post in a front-rear direction is larger than a dimension of the first insulating post in the front-rear direction; and a metal shell, wrapping the insulating body, wherein the metal shell frames outside the insulating body to form an insertion space for insertion of the mating connector, the metal shell is provided with at least one first protruding portion protruding toward the insertion space, the first protruding portion has a first height along a protruding direction thereof, the first height is greater than or equal to 0.042 mm and less than or equal to 0.08 mm, the first protruding portion has a first position limiting surface facing the first wall surface, a first clearance is provided between the first position limiting surface and the first wall surface, and the first clearance is greater than or equal to 0.001 mm and less than or equal to 0.0449 mm.

2. The electrical connector according to claim 1, wherein each of the notches is located closer to a central line of the middle grounding sheet in the front-rear direction relatively than each of the latch slots.

3. The electrical connector according to claim 2, wherein each of the notches has a first inner edge adjacent to and connected to the corresponding one of the latch slots, and the first insulating post is formed integrally with the first inner edge and abuts forward the first inner edge.

4. The electrical connector according to claim 1, wherein the mating connector has a retaining elastic sheet having a retaining portion fastened with a corresponding one of the latch slots, and when the retaining elastic sheet is fastened with the corresponding one of the latch slots, the retaining portion is located behind a front edge of the first protruding portion.

5. The electrical connector according to claim 1, wherein the metal shell is provided with at least one second protruding portion protruding toward the second wall surface, the mating connector has a retaining elastic sheet, the corresponding one of the latch slots has a side edge abutting the retaining elastic sheet, and when the retaining elastic sheet is fastened with the corresponding one of the latch slots, the retaining elastic sheet is at least partially located between the second protruding portion and the side edge of the corresponding one of the latch slots in a left-right direction.

6. The electrical connector according to claim 5, wherein the metal shell is provided with two second protruding portions protruding toward the second wall surface, one of the two second protruding portions is provided to be opposite to the side edge in the left-right direction, and the other of the two second protruding portions is located closer to an opening of the insertion space relative than the side edge.

7. The electrical connector according to claim 1, wherein the metal shell has two first protruding portions provided opposite to each other in a vertical direction, the tongue is located between the two first protruding portions, the metal shell further has at least one second protruding portion provided on at least one side of the tongue in the left-right direction, a first vertical surface passes through ends of the two first protruding portions facing the insertion space and an end of the second protruding portion facing the insertion space, and the tongue is located behind the first vertical surface.

8. The electrical connector according to claim 7, wherein the middle grounding sheet passes forward beyond a front end surface of the tongue and located behind the first vertical surface.

9. The electrical connector according to claim 1, wherein the first height remains unchanged before and after the mating connector is inserted into the insertion space.

10. The electrical connector according to claim 1, wherein each of the terminals has a mating portion exposed to a surface of the tongue, the terminals comprise at least one signal terminal, and the mating portion of the signal terminal and the first protruding portion are provided at least partially opposite to each other in a vertical direction.

11. The electrical connector according to claim 10, wherein the mating connector has a plurality of contact terminals, the mating portion of each of the terminals has a horizontal plate surface forming an abutting position with one of the contact terminals, and the first protruding portion extends forward beyond the horizontal plate surface of the signal terminal and extends backward beyond the abutting position formed by the signal terminal and the contact terminal.

12. An electrical connector, configured for a mating connector to be inserted thereto, the mating connector having a plastic body and a shielding casing wrapping the plastic body, and the electrical connector comprising:

an insulating body, having a base and a tongue provided at a front end of the base;

a plurality of terminals, formed in an upper row and a lower row, and respectively arranged on an upper surface and a lower surface of the tongue;

a middle grounding sheet, provided in the base and extending to the tongue, wherein the middle grounding sheet is located between the terminals in the upper row and the terminals in the lower row, the middle grounding sheet is provided with at least one first through hole, the middle grounding sheet has two latch slots and two notches concavely provided inward at a left side and a right side of the middle grounding sheet, the first through hole is located between the two notches, each of the notches has a first inner edge relatively close to a front side of the tongue and connected to a corresponding one of the latch slots, a second inner edge formed to be relatively away from the front side of the tongue, and a third inner edge connecting the first inner edge and the second inner edge, the insulating body has a first insulating post entering the first through hole and two second insulating posts correspondingly entering the notches, and a dimension of the second insulating post in a front-rear direction is larger than a dimension of the first insulating post in the front-rear direction; and a metal shell, framing outside the insulating body to form an insertion space for insertion of the mating connector, wherein the metal shell is provided with at least one first protruding portion protruding toward the insertion space, a first clearance is provided between the first position limiting surface and the shielding casing, and the first clearance is greater than or equal to 0.001 mm and less than or equal to 0.0449 mm.

13. The electrical connector according to claim 12, wherein each of the notches is located closer to a central line of the middle grounding sheet in the front-rear direction relatively than each of the latch slots, and the second insulating post abuts forward the first inner edge, abuts backward the second inner edge and abuts the third inner edge in a left-right direction.

14. The electrical connector according to claim 12, wherein the mating connector has a retaining elastic sheet having a retaining portion fastened with one of the latch slots, and when the retaining elastic sheet is fastened with the one of the latch slots, the retaining portion is located behind a front edge of the first protruding portion.

15. The electrical connector according to claim 12, wherein each of the terminals has a mating portion exposed to a surface of the tongue, the terminals comprise at least one signal terminal, and the mating portion of the signal terminal and the first protruding portion are provided at least partially opposite to each other in a vertical direction.

16. The electrical connector according to claim 15, wherein the mating connector has a plurality of contact terminals, the mating portion of each of the terminals has a horizontal plate surface forming an abutting position with one of the contact terminals, and the first protruding portion extends forward beyond the horizontal plate surface of the signal terminal and extends backward beyond the abutting position formed by the signal terminal and the contact terminal.

17. The electrical connector according to claim 12, wherein the metal shell is provided with at least one second protruding portion protruding toward the insertion space, the mating connector has a retaining elastic sheet, one of the latch slots has a side edge abutting the retaining elastic sheet, and when the retaining elastic sheet is fastened with the one of the latch slots, the retaining elastic sheet is at least partially located between the second protruding portion and the side edge of the one of the latch slots in a left-right direction.

18. The electrical connector according to claim 12, wherein the metal shell has two first protruding portions provided opposite to each other in a vertical direction, the tongue is located between the two first protruding portions, the metal shell further has at least one second protruding portion provided on at least one side of the tongue in the left-right direction, a first vertical surface passes through ends of the two first protruding portions facing the insertion space and an end of the second protruding portion facing the insertion space, and the tongue is located behind the first vertical surface.

19. The electrical connector according to claim 18, wherein the middle grounding sheet passes forward beyond a front end surface of the tongue and located behind the first vertical surface.

20. The electrical connector according to claim 12, wherein the first protruding portion has a first height in a protruding direction thereof, and the first height remains unchanged before and after the mating connector is inserted into the insertion space.

* * * * *